US005153107A

United States Patent [19]

Deguchi

[11] Patent Number: 5,153,107

[45] Date of Patent: Oct. 6, 1992

[54] DIRECT POSITIVE COLOR PHOTOGRAPHIC MATERIAL

[75] Inventor: Naoyasu Deguchi, Kanagawa, Japan

[73] Assignee: Fuji Photo Film Co., Ltd., Kanagawa, Japan

[21] Appl. No.: 609,855

[22] Filed: Nov. 7, 1990

[30] Foreign Application Priority Data

Nov. 7, 1989 [JP] Japan ..... 1-289335

[51] Int. Cl.[5] ..... G03C 7/18; G03C 7/36; G03C 7/38

[52] U.S. Cl. ..... 430/358; 430/378; 430/504; 430/547; 430/549

[58] Field of Search ..... 430/549, 547, 358, 504, 430/378

[56] References Cited

U.S. PATENT DOCUMENTS 4,770,980 9/1988 Matejec et al. ..... 430/504
4,806,460 2/1989 Ogawa et al. ..... 430/504
5,013,633 5/1991 Yoshizawa et al. ..... 430/358

FOREIGN PATENT DOCUMENTS 0311110 12/1989 European Pat. Off. .
1474994 6/1974 United Kingdom .

OTHER PUBLICATIONS

European Search Report No. 90 12 1291, Dec. 17, 1990, Examiner S. Magrizos, contains items 1 and 3.
European Search Report No. 88 11 6672, Feb. 7, 1990, Examiner S. Magrizos, contains item 2.

*Primary Examiner*—Richard L. Schilling
*Attorney, Agent, or Firm*—Sughrue, Mion, Zinn, Macpeak & Seas

[57] ABSTRACT

A direct positive color photographic material having comprising a support at least one previously non-fogged internal latent image-type silver halide emulsion, in which at least one green-sensitive internal latent image-type silver halide emulsion layer contains a 2-equivalent yellow-coloring coupler and a magenta-coloring coupler of the following general formula (M-II)

(M-II)

where $R_{10}$ represents a hydrogen atom or a substituent;

$Y_4$ represents a hydrogen atom or a removing group;

Za, Zb and Zc each represents a methine group, a substituted methine group, =N— or —NH—;

one of the Za—Zb bond and the Zb—Zc bond is a double bond and the other is a single bond; and when the Zb—Zc bond is a carbon-carbon double bond, it may be part of an aromatic ring; and a dimer or a polymer at the position of $R_{10}$ or $Y_4$ or at the position of Za, Zb or Zc when Za, Zb or Zc is a substituted methine group is formed, where the relative coupling rate of the 2-equivalent yellow-coloring coupler to the magenta-coloring coupler is within the range of from 0.5 to 2.0, and at least one layer of the photographic material contains at least one compound selected from the group consisting of compounds of the following general formulae (II) and (III):

(II)

where

Q represents an atomic group necessary for forming a 5-membered or 6-membered hetero ring, which may be condensed with a carbocyclic-aromatic ring or heterocyclic-aromatic ring;

L represents a divalent linking group composed of one or more atoms selected from hydrogen, carbon, nitrogen, oxygen and sulfur atoms;

$R^3$ represents an organic group containing at least one of a thioether group, an amino group, an ammonium group, an ether group and a heterocyclic group;

n represents 0 or 1; m represents 0, 1 or 2; and

M represents a hydrogen atom, an alkali metal atom, an ammonium group, or a group capable of being cleaved under alkaline conditions.

(III)

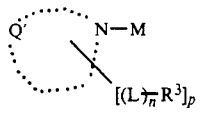

where

Q' represents an atomic group necessary for forming a 5-membered or 6-membered heterocyclic ring which may form an imino silver;

L, $R^3$, n and M have the same meaning as in the above-mentioned formula (II); and p represents 1 or 2.

14 Claims, 1 Drawing Sheet

FIG.
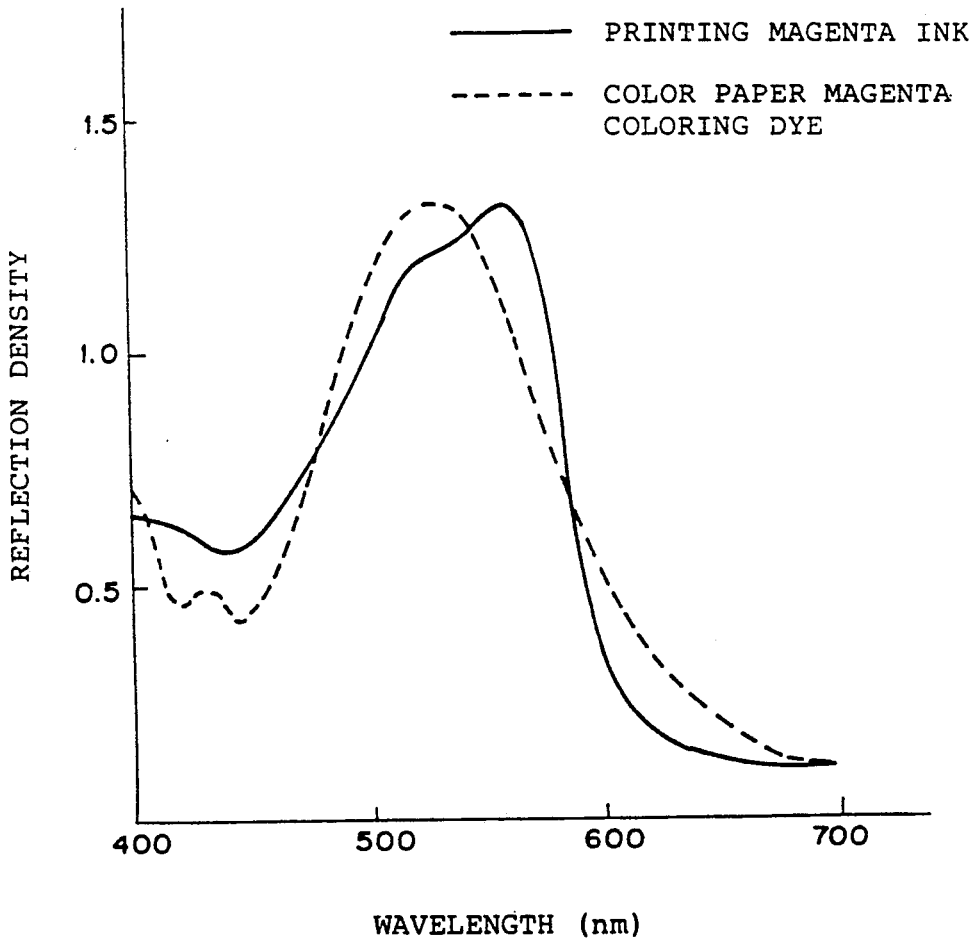

DIRECT POSITIVE COLOR PHOTOGRAPHIC MATERIAL

FIELD OF THE INVENTION

The present invention relates to a direct positive silver halide photographic material and to a method of forming a direct positive image on the material.

BACKGROUND OF THE INVENTION

Photography of forming a direct positive image without employing a reversal step or using a negative film is well known.

A conventionally known process of forming a positive image with a known direct positive silver halide photographic material may be essentially be classified into the following two types, with certain exceptions, considering the practical usefulness of the process.

One type produces a direct positive image, where a previously fogged silver halide emulsion is used and the fogged nuclei (latent image) in the exposed area is broken by solarization or the Herschel effect for development to thereby obtain the intended direct positive image.

The other type produces a direct positive image, where a non-fogged internal latent image-type silver halide emulsion is used and the emulsion is, after imagewise exposure, subjected to surface development during or after a fogging treatment to thereby obtain the intended direct positive image.

The above-mentioned internal latent image-type silver halide photographic emulsion means a silver halide photographic emulsion of a type such that the silver halide grains therein have light-sensitive nuclei essentially in the inside thereof and a latent image is formed essentially in the inside of the grains by exposure.

The method of the latter type generally has a higher sensitivity than that of the former type and is therefore suitable for uses which require a high sensitivity. The present invention relates to the latter type.

Various techniques are known in this technical field. For instance, U.S. Pat. Nos. 2,592,250, 2,466,957, 2,496,875, 2,588,982, 3,317,322, 3,761,266, 3,761,276 and 3,796,577 and British Patents 1,151,363, 1,150,553 and 1,011,062 illustrates essential techniques known in the field.

Using known methods, direct positive photographic materials having a relatively high sensitivity can be obtained.

The details of the mechanism of forming direct positive images are given, for example, in T. H. James, *The Theory of the Photographic Process,* Ed. 4, Chap. 7, pages 182 to 193 and U.S. Pat. No. 3,761,276.

More specifically, it is considered that fogged nuclei are selectively formed on the surfaces of non-exposed silver halide grains because of the surface-desensitization action caused by a so-called internal latent image formed in the inside of the silver halide grains by the first imagewise exposure, and thereafter the thus fogged nuclei-containing emulsion is then subjected to a general so-called surface development to ultimately form a photographic image (direct positive image) in the non-exposed area.

Suitable means of selectively forming fogged nuclei, in general, include a so-called "light-fogging method" in which the complete surface of the light-sensitive layer (for example, British Patent 1,151,363) is subjected to a second exposure and a so-called "chemical fogging method" in which a nucleating agent is used The latter method is described in detail, for example, in *Research Disclosure,* Vol. 151, No. 15162 (issued in November, 1976), pages 76 to 78.

For forming a direct positive color image, an internal latent image-type silver halide photographic material is subjected to surface color development after or during fogging, and thereafter it is bleached and fixed (or bleach-fixed). After the bleach-fixing step, the material is generally rinsed in water and/or stabilized.

Investigations have been made to apply a direct positive color photographic material to a print-related fields because the characteristics involve forming a positive color image simply and rapidly.

However, a printing ink is quite different from a coloring dye used in a general color photographic material from the standpoint of the spectral characteristics.

For instance, a printing magenta ink is quite different from a magenta-coloring dye used in a color photographic material, as shown in the Figure. Accordingly, where the direct positive color photographic material of the present invention is applied to a print-related field, it is necessary for the color characteristics of the magenta-coloring dye in the color photographic material to be similar to those of a printing magenta ink.

The spectral absorption of a printing ink is extremely sharp in the long wavelength range and the short wavelength range has a large amount of blue absorption. In the case of a color photographic material, it is considered extremely difficult to form a colored dye having a similar spectral absorption characteristic as a printing ink has, from a coupler of one kind in the material.

Accordingly, incorporation of both a magenta-coloring coupler capable of forming a color dye having a sharp spectral absorption and an yellow-coloring coupler into the green-sensitive emulsion of the photographic material as a mixture of the two might be considered.

As a magenta-coloring coupler, a pyrazoloazole magenta coupler forming a color dye having a small amount of side-absorption of a cyan component and having a sharp spectral absorption is preferred.

However, based on present research, it has been found that incorporation of both an yellow coupler and a pyrazoloazole magenta coupler into the same light-sensitive emulsion layer often gives color dyes of different hues in the low-density portion and the high-density portion.

Additionally, where a direct positive color photographic material containing the above-mentioned yellow coupler and pyrazoloazole coupler in the same emulsion layer is stored at room temperature for a long period of time, a severe problem occurs in that the quality of the image formed is noticeably deteriorated. Precisely, in such a case, the maximum image density ($D_{max}$) of the image formed is reduced and the minimum image density ($D_{min}$) thereof is increased.

In the situation, development of a direct positive color photographic material which may be applied to a print-related field without problems in the color hue of the color image formed as well as in storability of the material is strongly desired.

SUMMARY OF THE INVENTION

An object of the present invention is to provide a direct positive color photographic material which may be employed in print-related fields and which forms a direct positive color image of high quality where the low-density area of the magenta-coloring dye is not substantially different from the high-density area thereof with respect to the hue and the magenta-coloring dye is similar to a printing magenta ink in spectral absorption.

The object has been attained by a direct positive color photographic material comprising a support having thereon at least one previously non-fogged internal latent image-type silver halide emulsion, in which at least one green-sensitive internal latent image-type silver halide emulsion layer contains a 2-equivalent yellow-coloring coupler and a magenta-coloring coupler of the following general formula (M-II),

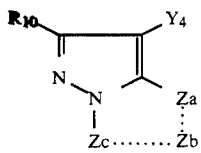

(M-II)

where $R_{10}$ represents a hydrogen atom or a substituent; $Y_4$ represents a hydrogen atom or a removing group;

Za, Zb and Zc each represent a methine group, a substituted methine group, =N— or —NH—;

one of the Za—Zb bond and the Zb—Zc bond is a double bond and the other is a single bond; and when the Zb—Zc bond is a carbon-carbon double bond, it may be a part of an aromatic ring; and a dimer or a higher polymer may be formed at the position of $R_{10}$ or $Y_4$ or at the position of Za, Zb or Zc when Za, Zb or Zc is a substituted methine group; with the relative coupling rate of the 2-equivalent yellow-coloring coupler to the magenta-coloring coupler being within the range of from 0.5 to 2.0, and at least one layer of the photographic material contains at least one compound selected the group consisting of compounds of the following general formulae (II) and (III):

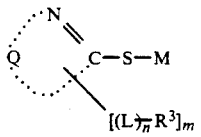

(II)

where

Q represents an atomic group necessary for forming a 5-membered or 6-membered hetero ring, which may be condensed with a carbocyclic-aromatic ring or a heterocyclic-aromatic ring;

L represents a divalent linking group composed of one or more atoms selected from hydrogen, carbon, nitrogen, oxygen and sulfur atoms;

$R^3$ represents an organic group containing at least one of a thioether group, an amino group, an ammonium group, an ether group and a heterocyclic group;

n represents 0 or 1; m represents 0, 1 or 2; and

M represents a hydrogen atom, an alkali metal atom, an ammonium group or a group capable of being cleaved under alkaline conditions;.

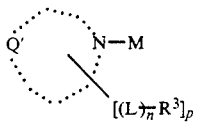

(III)

where

Q' represents an atomic group necessary for forming a 5-membered or 6-membered hetero ring which may form an imino silver;

L, $R^3$, n and M have the same meanings as in the above-mentioned formula (II); and p represents 1 or 2.

BRIEF DESCRIPTION OF THE DRAWING

The Figure shows the spectral asorption curves of a printing magenta ink and a photographic magenta-coloring dye.

DETAILED DESCRIPTION OF THE INVENTION

The relative coupling rate of the 2-equivalent yellow coupler to the magenta coupler of formula (M-II) employed in the present invention is determined as mentioned below.

The reactivity of the yellow coupler and the hue of the dye formed from the coupler vary depending on the kind and amount of oil used therewith. Therefore, the relative coupling rate of the yellow coupler to the magenta coupler is determined with respect to the kind and amount of the oil to be used.

A magenta coupler (M) and a yellow coupler (Y) are blended and are emulsified and dispersed with an oil of the kind to be actually used whereupon the amount of the oil is that to be actually used. The resulting dispersion is added to an emulsion, which is then color-developed. Then the amount of the dye in the color image obtained after color-development is measured, whereby the coupling rate is obtained as relative value.

Where the maximum density of the color from the magenta coupler (M) is represented by $(DM)_{max}$, the color density thereof in the middle stage is represented by (DM), the maximum density of the color from the yellow coupler (Y) is represented by $(DY)_{max}$, and the color density thereof in the middle stage is represented by (DY), then the ratio of the reactivity of the two couplers (or relative coupling rate) RM/RY is represented by the following formula:

$$\frac{RM}{RY} = \frac{\log\left(1 - \frac{DM}{(DM)_{max}}\right)}{\log\left(1 - \frac{DY}{(DY)_{max}}\right)}$$

That is, the relative coupling rate (RM/RY) is obtained from the gradient of a line obtained by plotting several values of DM and DY, which are obtained by exposing an emulsion containing the two blended couplers with lights of various stages followed by color development of the exposed emulsion, on two axes crossing at right angles as $$\log\left(1-\frac{D}{D_{max}}\right).$$

The relative coupling rate of the 2-equivalent yellow-coloring coupler to the magenta-coloring coupler of the formula (M-II), the two couplers being mixed and incorporated into the green-sensitive emulsion layer of the photographic material of the present invention, is from 0.5 to 2.0, preferably from 0.55 to 1.8, especially preferably from 0.6 to 1.7.

Where the yellow coupler admixed with the magenta coupler of formula (M-II) in at least one green-sensitive emulsion layer in the photographic material of the present invention is a 4-equivalent coupler, not only is the density of the colored dye from the yellow component but also that from the magenta component markedly decreased. Therefore, this is undesirable.

Compounds of formula (M-II) are known as pyrazoloazole couplers. Of the pyrazoloazole couplers useful in the present invention, imidazo[1,2-b]pyrazoles described in U.S. Pat. No. 4,500,630 are preferred; and pyrazolo[1,5-b][1,2,4]triazoles as described in U.S. Pat. No. 4,540,654 are especially preferred.

Additionally, pyrazolotriazole couplers where a branched alkyl group is directly bonded to the 2-, 3- or 6-position of the pyrazolotriazole ring, as described in JP-A-61-65245 (the term "JP-A" as used herein means an "unexamined published Japanese patent application"); pyrazoloazole couplers which have an alkoxyphenylsulfonamido ballast group or have a sulfonamido group in the molecule, as described in JP-A-61-65246; and pyrazolotriazole couplers having an alkoxy group or an aryloxy group at the 6-position, as described in European Patent (Laid-Open) Nos. 226,849 and 294,785, are desirably used.

In the formula (M-II), $R_{10}$ represents a hydrogen atom, an alkyl group, an aryl group, a heterocyclic group, a cyano group, a hydroxy group, a nitro group, a carboxy group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group. $R_{10}$ may form a bis form with a divalent group.

More specifically, $R_{10}$ represents a- hydrogen atom, a halogen atom (e.g., chlorine, bromine), an alkyl group ($C_{1-32}$ straight or branched alkyl, aralkyl, alkenyl, alkynyl, cycloalkyl, or cycloalkenyl, e.g., methyl, ethyl, propyl, iso-propyl, t-butyl, tridecyl, 2-methanesulfonylethyl, 3-(3-pentadecylphenoxy)propyl, 3-(4-(2-(4-(4 -hydroxyphenylsulfonyl)phenoxy)-dodecanamido)phenyl)propyl, 2-ethoxytridecyl, trifluoromethyl, cyclopentyl, 3-(2,4-di-t-amylphenoxy)propyl), an aryl group (e.g., phenyl, 4-t-butylphenyl, 2,4-di-t-amylphenyl, 4-tetradecanamidophenyl),a heterocyclic group (e.g., 2-furyl, 2-thienyl, 2-pyrimidinyl, 2-benzothiazolyl), a cyano group, a hydroxy group, a nitro group, a carboxy group, an amino group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-t-butylphenoxy, 3-nityrophenoxy, 3-t-butyloxy carbamoylphenoxy, 3-methoxycarbamoyl), an acylamino group (e.g., acetoamido, benzamido, tetradecanamido, 2-(2,4-di-amyphenoxy)butamanido, 4-(3-t-butyl-4-hydroxyphenoxy)butanamido, 2-(4-(4-hydroxyphenylsulfonyl)-phenoxy)decanamido), an alkylamino group (e.g., methylamino, butyramino, dodecylamino, diethylamino, methylbutyramino), an anilino group (e.g., phenylamino, 2-chloroanilino, 2-chloro-5-tetradecanaminoanilino, 2-chloro-5-dodecyloxycarbonylanilino, N-acetylanilino, 2-chloro-5-(o-(3-t-butyl-4-hydroxyphenoxy)dodecanamido)anilino), a ureido group (e.g., phenylureido, methylureido, N,N-dibutylureido), a sulfamoylamino group (N,N-dipropylsulfamoylamino, N-methyl-N-decylsulfamoylamino), an alkylthio group (e.g., methyltio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-ocylphenylthio, 3-pentadecylphenylthio, 2-carboxyphenylthio, 4-tetradecanamidophenylthio), an alkoxycarbonylamino group (e.g., methoxycarbonylamino, tetradecyloxycarbonylamino), a sulfonamido group (e.g., methansulfonamido, hexadecansulfonamido, benzensulfonamido, p-toluenesulfonamido, octadecansulfonamido, 2-methyloxy1- 5-t-butylbenzensulfonamido), a carbamoyl group (N-ethylcarbamoyl, N,N-dibutylcarbamoyl, N-(2-dodecyloxyethyl)carbamoyl, N-methyl-N-dodecylcarbamoyl, N-(3-(2,4-di-t-amylphenoxy)propyl)-carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonyl), an alkoxycarbonyl group (e.g., methoxycarbonyl, butyloxycarbonyl, dodecyloxycarbonyl, octadecyloxycarbonyl), a heterocyclic oxy group (e.g., 1-phenyltetrazole-5-oxy, 2-tetrahydroxypyranyloxy), an azo group (e.g., phenylazo, 4-methoxyphenylazo, 4-pivaloylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), anaryloxycarbonylaminogroup (e. g., phenoxycarbonylamino), an imido group (e.g., N-succinimido, N-phthalimido, 3-octadecenylsuccinimido), a heterocyclic thio group (e.g., 2-benzothiazolythio, 2,4- di-phenoxy-1,3,5-triazole-6-thio, 2-pyridylthio), a sulfinyl group (e.g., dodecansulfinyl, 3-pentadecylphenylsulfinyl, 3-phenoxypropylsulfinyl), a phosphonyl group (e.g., phenoxyphosphonyl, octyloxyphosphonyl, phenylphosphonyl), an aryloxycarbonyl group (e.g., phenoxycarbonyl), an acyl group (e.g., acetyl, 3-phenylpropanoyl, benzoyl, 4-dodecyloxybenzoyl), and an azolyl group (e.g., imidazolyl, pyrazolyl, 3-chloro-pyrazol-1-yl, triaxzolyl). Of these substituents, a substituent which can be further substituted may be further substituted with an organic substituent which can be bonded by a carbon atom, an oxygen atom, a nitrogen atom or a sulfur atom, or a halogen atom.

Among these substituents, preferred $R_{10}$ includes an alkyl group, an aryl group, an alkoxy group, an aryloxy group, an alkylthio group, a ureido group, a urethane group, and an acylamino group.

The substituent for the substituted methine group means the same group as defined for $R_{10}$, preferably it includes a hydrogen atom, an alkyl group, an aryl group, a heterocyclic group, an alkoxy group, an aryloxy group, an alkylthio group, an arylthio group, an alkoxycarbonyl group, a carbamoyl group, an acyl group, a sulfamoyl group, a sulfinyl group, and a cyano group, more preferably it includes an alkyl group, an aryl group, a heterocyclic group, an alkylthio group, and an arylthio group.

$Y_4$ represents a hydrogen atom or a releasable group upon reaction with an oxidation product of a primary aromatic amine developing agent. Specifically, the releasable group includes a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl-, aryl- or heterocyclic thio group, a carbamoylamino group, 5- or 6-membered nitrogen-containing heterocyclic group, an imido group, an arylazo group. These groups may be further substituted with a substituent for $R_{10}$.

More specifically, the releasable group includes a halogen atom (e.g., fluorine, chlorine, bromine), an alkoxy group (e.g., ethoxy, d-odecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), an acyloxy group (e.g., acetoxy, tetradecanoyloxy, benzoyloxy), an alkyl- or arylsulfonyloxy group (e.g., methanesulfonyloxy, toluenesulfonyloxy), an acylamino group (e.g., dichloroacetylamino, heptafluorobutyramino), an alkyl- or arylsulfonamido group (e.g., methanesulfonamido, trifluoromethanesulfonamido, p-toluenesulfonylamido), an alkoxycarbonyloxy group (e.g., ethoxycarbonyloxy, benzyloxycarbonyloxy), an aryloxycarbonyloxy group (e.g., phenoxycarbonyloxy), an alkyl, aryl or heterocyclic thio group (e.g., dodecylthio, 1-carboxydodecylthio, phenylthio, 2-butoxy-5-t-octylphenylthio, tetrazolylthio), a carbamoylamino group (e.g., N-methylcarbamoylamino, N-phenylcarbamoylamino), 5- or 6-membered nitrogen-containing heterocyclic group (e.g., imidazolyl, pyrazolyl, triazolyl, tetrazolyl, 1,2-dihydro-2-oxo-1-pyridyl), and an imido group (e.g., succinimido, hydantoynyl), an arylazo group (e.g., phenylazo, 4-methoxyphenylazo). Other than these group, $Y_4$ may be in the form of a bis-type coupler which can be obtained by condensing a 4-equivalent coupler with an aldehyde or a ketone as a removing group which is bonded via a carbon atom. Furthermore, $Y_4$ may include a photographically useful group such as a development inhibitor and a development accelerator. Preferably, $Y_4$ is a halogen atom, an alkoxy group, an aryloxy group, an alkyl- or arylthio group, or a 5- or 6-membered heterocyclic group bonded by a nitrogen atom at a coupling active position.

The amount of the coupler represented by formula (M-II) used in the photographic material of the present invention from $1\times10^{-3}$ mol to $1\times10^{-1}$ mol, more preferably $5\times10^{-2}$ mol to $3\times10^{-1}$ mol, per mol of silver.

Specific examples of pyrazoloazole couplers of formula (M-II) are mentioned below, which, however, do not whatsoever restrict the scope of the present invention.

| Compound | $R_{10}$ | $R_{15}$ | $Y_4$ |
|---|---|---|---|
| | | 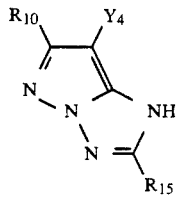 | |
| M-9 | $CH_3$— | 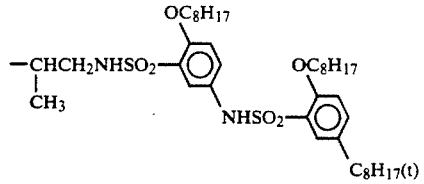 | Cl |
| M-10 | " | 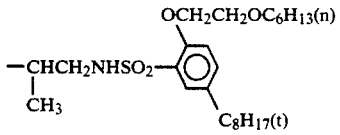 | " |
| M-11 | $(CH_3)_3C$— | 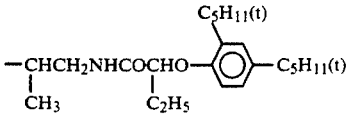 | 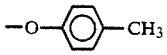 |

-continued
| Compound | $R_{10}$ | $R_{15}$ | $Y_4$ |
|---|---|---|---|
| M-12 | 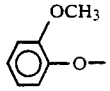 | 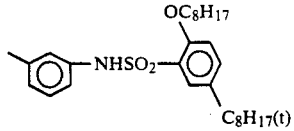 | 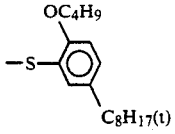 |
| M-13 | $CH_3$— | 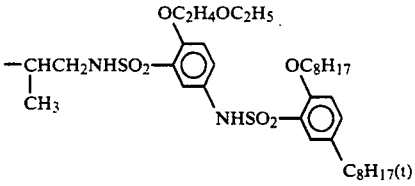 | Cl |
| M-14 | " | 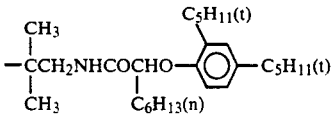 | " |
| M-15 | " | 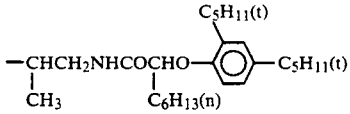 | " |
| M-16 | $CH_3$— | 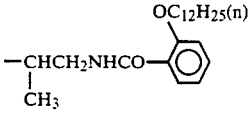 | Cl |
| M-17 | " | 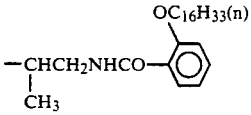 | " |
| M-18 | 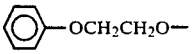 | 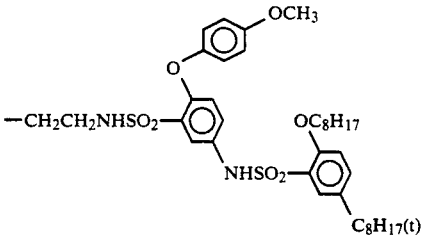 | 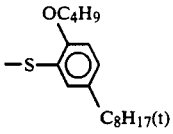 |
| M-19 | $CH_3CH_2O$— | " | " |
| M-20 | 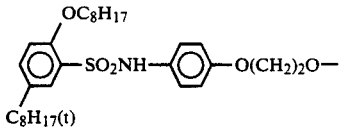 | 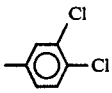 | 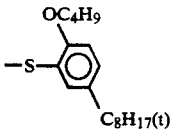 |
| M-21 | 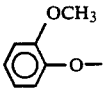 | 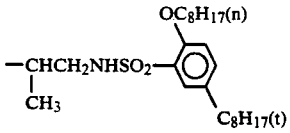 | Cl |
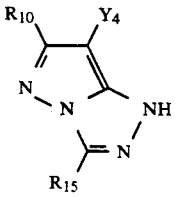

-continued

| Compound | $R_{10}$ | $R_{15}$ | $Y_4$ |
|---|---|---|---|
| M-22 | $CH_3$— | 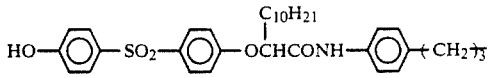 | Cl |
| M-23 | " | 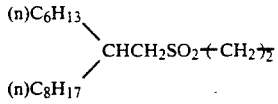 | " |
| M-24 | 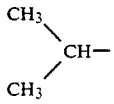 | 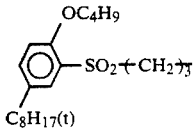 | " |
| M-25 | 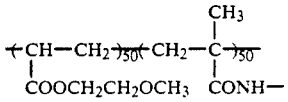 | 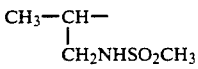 | " |
| M-26 | 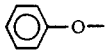 | 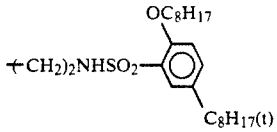 | Cl |
| M-27 | $CH_3$— | 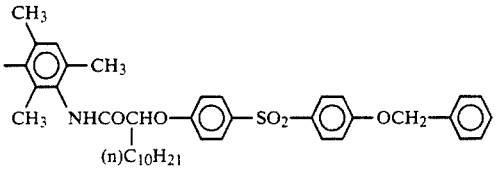 | " |
| M-28 | $(CH_3)_3C$— | 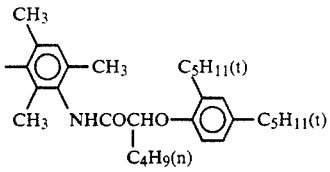 | " |
| M-29 | 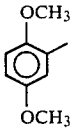 | 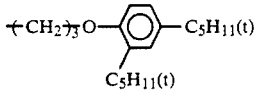 | Cl |
| M-30 | $CH_3$— | 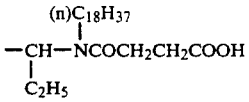 | Cl |

The yellow coupler which is preferably employed along with the magenta coupler of formula (M-II) in the present invention is one represented by the following general formula (Y-I). Additionally, yellow couplers of the general formula (Y-XI), mentioned below may also be employed.

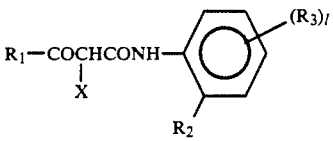

(Y-I)

where $R_1$ represents a $C_{4-24}$ tertiary alkyl group or a $C_{6-24}$ aryl group; $R_2$ represents a hydrogen atom, a halogen atom (e.g., chlorine, fluorine), a $C_{1-24}$ alkoxy group or a $C_{6-24}$ aryloxy group;

$R_3$ represents a halogen atom, a $C_{1-24}$ alkyl group, a $C_{6-24}$ aryl group, a $C_{1-24}$ alkoxy group, a $C_{2-24}$ alkoxycarbonyl group, a $C_{7-24}$ aryloxycarbonyl group, a $C_{1-24}$ carbonamido group, a $C_{1-24}$ sulfonamido group, a $C_{1-24}$ Carbamoyl group, a $C_{0-24}$ sulfamoyl group, a $C_{1-24}$ alkylsulfonyl group, a $C_{6-24}$ arylsulfonyl group, a $C_{1-24}$ ureido group or a $C_{2-24}$ alkoxycarbonylamino group;

X represents a heterocyclic group to be bonded to the coupling-active position of the yellow dye-forming coupler of formula (Y-I) via a nitrogen atom (which is the same as defined in formula (Y-XI) later), or a $C_{6-30}$ aryloxy group;

l represents an integer of from 0 to 4, provided that when l represents a plural number, the $(R_3)$'s may be the same or different; and a dimer or a higher polymer may be formed at the position of $R_1$, $R_2$, $R_3$ or X.

Specific examples of yellow dye-forming couplers of formula (Y-I) are described below, which, however, are not intended to restrict the scope of the present invention.

(Y-1)

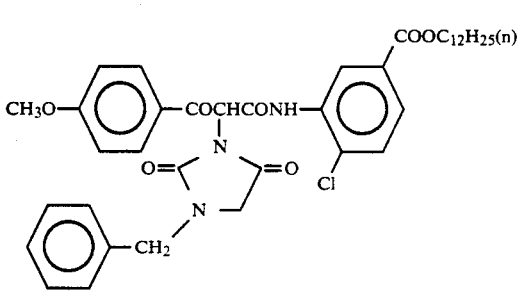

(Y-2)

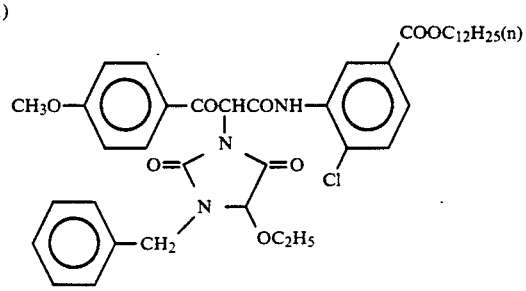

(Y-3)

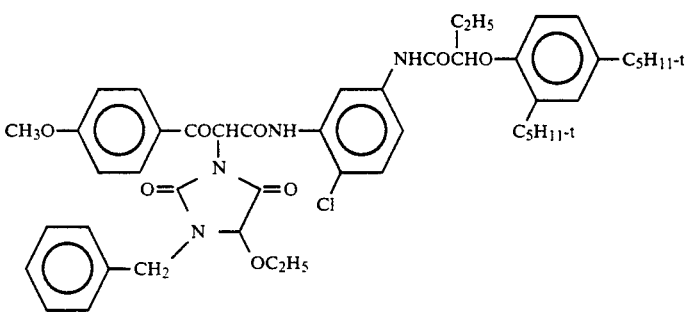

(Y-4)

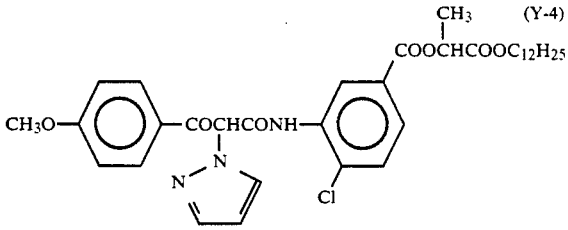

(Y-5)

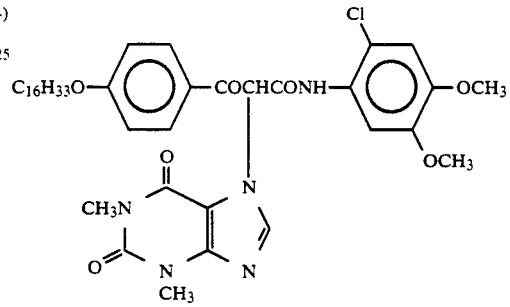

(Y-6)

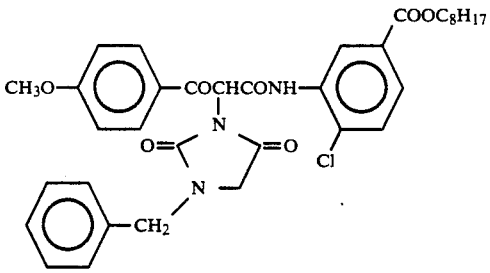

(Y-7)

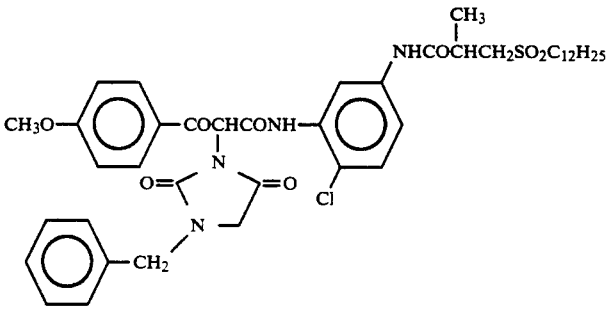

-continued
(Y-8)
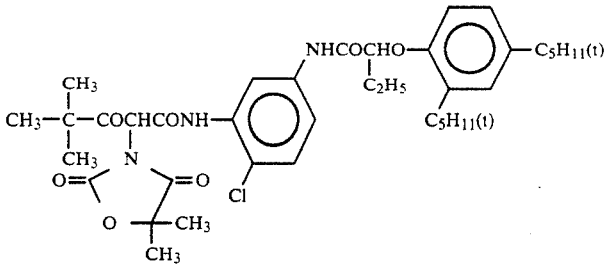
(Y-9)
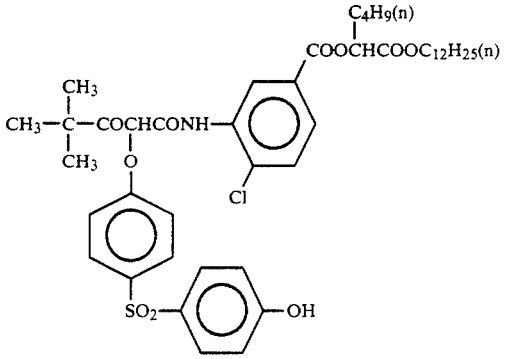
(Y-10)
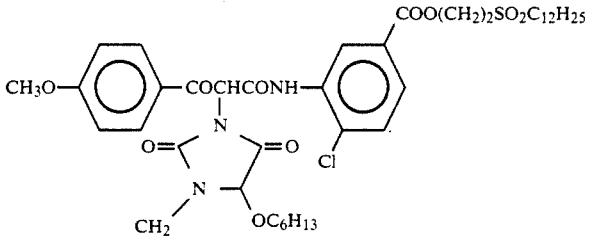
(Y-11)
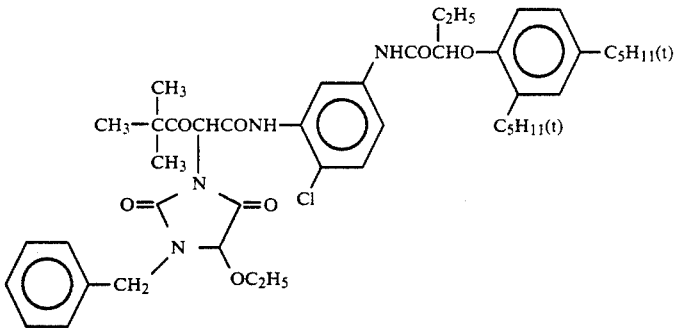
(Y-12)
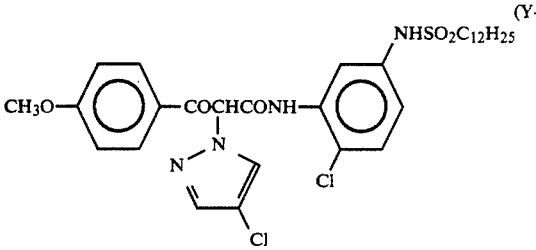
(Y-13)
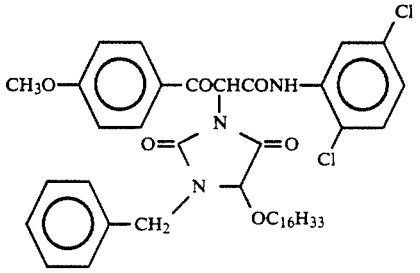

-continued
(Y-14)
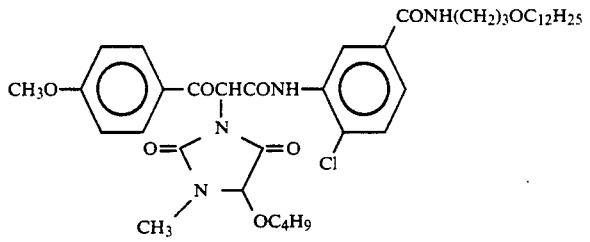
(Y-15)
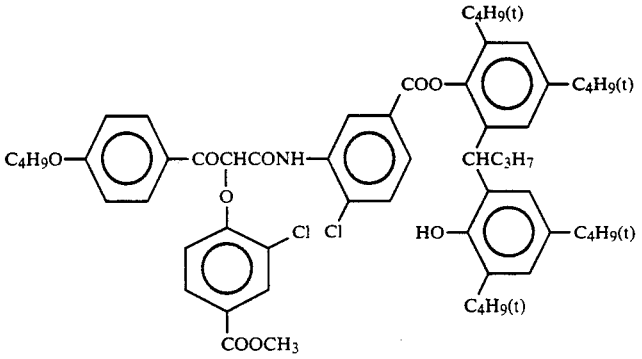
(Y-16)
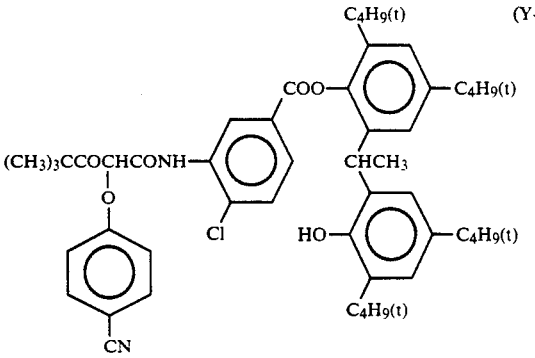
(Y-17)
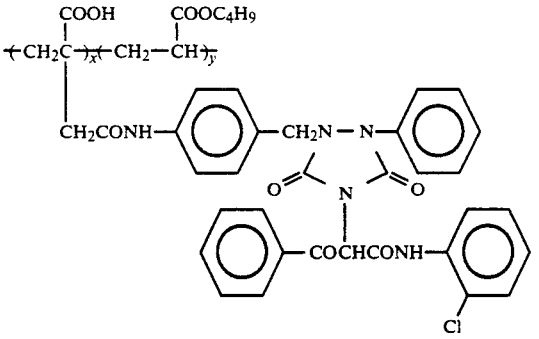
x = 40 wt %
y = 60 wt %
(Y-18)
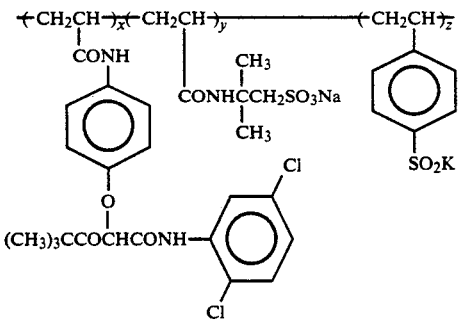
x = 50 wt %
y = 10 wt %
z = 40 wt %
(Y-19)
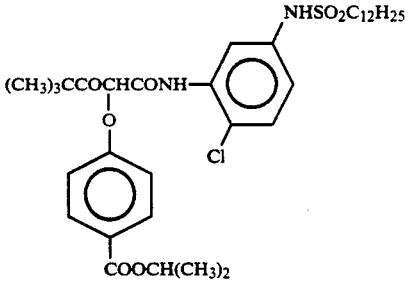

-continued
(Y-20)
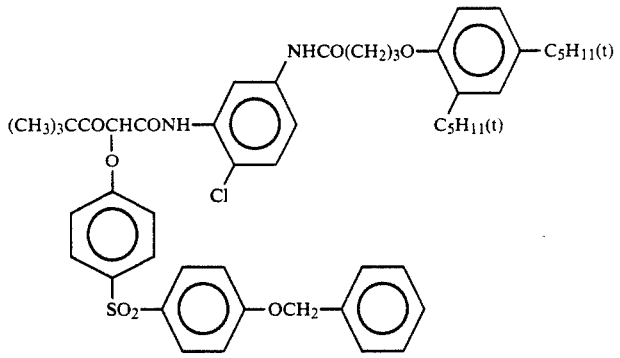
(Y-21)
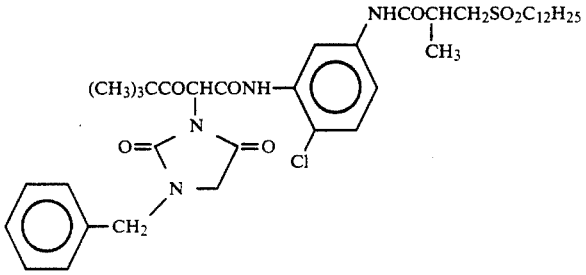
(Y-22)
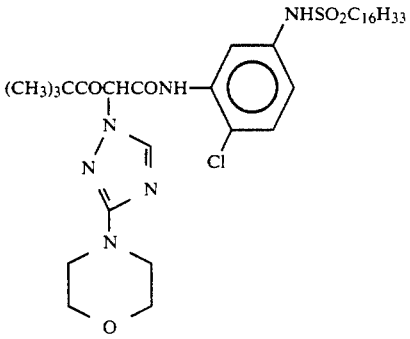
(Y-23)
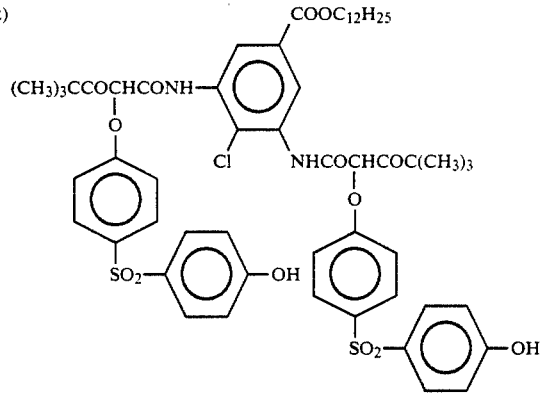
(Y-24)
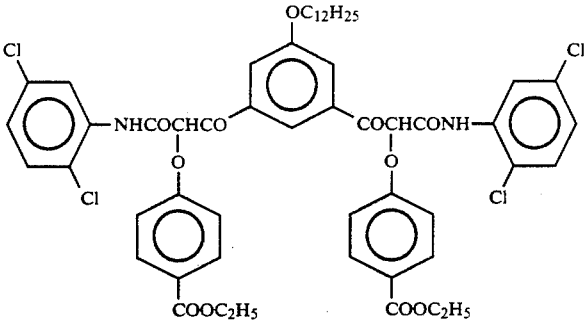
(Y-25)
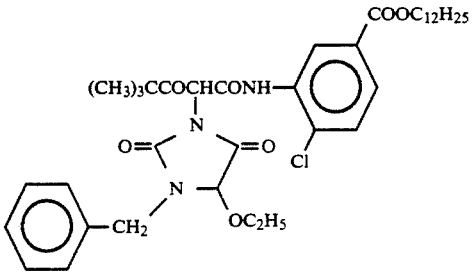
(Y-26)
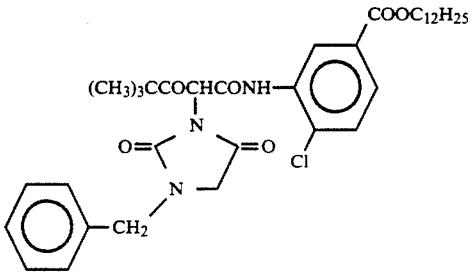

-continued

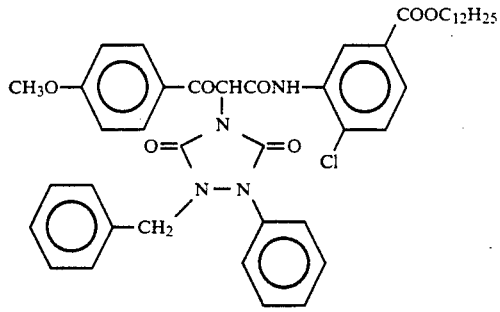

(Y-27)

Compounds of the above-mentioned formulae (II) and (III) are described in greater detail hereinafter.

In formula (II), Q preferably represents an atomic group necessary for forming a 5-membered or 6-membered hetero ring composed of atoms of at least one of carbon, nitrogen, oxygen, sulfur and selenium atoms, and the hetero ring may optionally be condensed with a carbocyclic-aromatic ring or a heterocyclic-aromatic ring.

Examples of suitable hetero rings are tetrazoles, triazoles, imidazoles, thiadiazoles, oxadiazoles, selenadiazoles, oxazoles, thiazoles, benzoxazoles, benzothiazoles, benzimidazoles and pyrimidines.

The hetero ring may optionally be substituted by one or more substituents selected from a nitro group, a halogen atom (e.g., chlorine, bromine), a mercapto group, a cyano group, a substituted or unsubstituted alkyl group (e.g., methyl, ethyl, propyl, t-butyl, (e.g., phenyl, 4-methanesulfonamidophenyl, 4-methylphenyl, 3,4-dichlorophenyl, naphthyl), a substituted or unsubstituted alkenyl group (e.g., allyl), a substituted or unsubstituted aralkyl group (e.g., benzyl, 4-methylbenzyl, phenethyl), a substituted or unsubstituted sulfonyl group (e.g., methanesulfonyl, ethanesulfonyl, p-toluenesulfonyl), a substituted or unsubstituted carbamoyl group (e.g., unsubstituted carbamoyl, methylcarbamoyl, phenylcarbamoyl), a substituted or unsubstituted sulfamoyl group (e.g., unsubstituted sulfamoyl, methylsulfamoyl, phenylsulfamoyl), a substituted or unsubstituted carbonamido group (e.g., acetamido, benzamido), a substituted or unsubstituted sulfonamido group (e.g., methanesulfonamido, benzenesulfonamido, p-toluenesulfonamido), a substituted or unsubstituted acyloxy group (e.g., acetyloxy, benzoyloxy), a substituted or unsubstituted sulfonyloxy group (e.g., methanesulfonyloxy), a substituted or unsubstituted ureido group (e.g., unsubstituted ureido, methylureido, ethylureido, phenylureido), a substituted or unsubstituted thioureido group (e.g., unsubstituted thioureido, methylthioureido), a substituted or unsubstituted acyl group (e.g., acetyl, benzoyl), a substituted or unsubstituted oxycarbonyl group (e.g., methoxycarbonyl, phenoxycarbonyl), a substituted or unsubstituted oxycarbonylamino group (e.g., methoxycarbonylamino, phenoxycarbonylamino, 2-ethylhexyloxycarbonylamino), a carboxylic acid or salt thereof, a sulfonic acid or salt thereof, and a hydroxyl group. However, the hetero ring is preferably not substituted by a carboxylic acid or salt thereof, a sulfonic acid or salt thereof, or a hydroxyl group. The carbon number range of these groups is up to 30.

Preferred examples of hetero rings represented by Q are tetrazoles, triazoles, imidazoles, thiadiazoles and oxadiazoles.

M represents a hydrogen atom, an alkali metal atom (e.g., sodium, potassium), an ammonium group (e.g., trimethylammonium, dimethylbenzylammonium), or a group capable of being M=H or an alkali metal atom under alkaline conditions (e.g., acetyl, cyanoethyl, methanesulfonylethyl).

L represents a divalent linking group composed of one or more atoms selected from hydrogen, carbon, nitrogen, oxygen and sulfur atoms. Examples of suitable divalent linking groups include

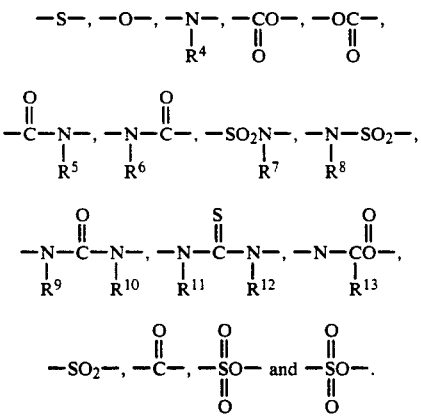

The above-mentioned hetero ring Q is bonded to the left side of the illustrated linking group L.

The linking group may be bonded to the group $R^3$ or to the above-mentioned hetero ring, via a linear or branched $C_{1-20}$ alkylene group (e.g., methylene, ethylene, propylene, butylene, hexylene, 1-methylethylene), or a substituted or unsubstituted $C_{6-20}$ arylene group (e.g., phenylene, naphthylene).

$R^4$, $R^5$, $R^6$, $R^7$, $R^8$, $R^9$, $R^{10}$, $R^{11}$, $R^{12}$ and $R^{13}$ each represents a hydrogen atom, a substituted or unsubstituted $C_{1-20}$ alkyl group (e.g., methyl, ethyl, propyl, n-butyl), a substituted or unsubstituted $C_{6-20}$ aryl group (e.g., phenyl, 2-methylphenyl), a substituted or unsubstituted $C_{1-20}$ alkenyl group (e.g., propenyl, 1-methylvinyl), or a substituted or unsubstituted $C_{7-20}$ aralkyl group (e.g., benzyl, phenethyl).

$R^3$ represents an organic group containing at least one of a thioether group, an amino group (including salts thereof), an ammonium group, an ether group and a heterocyclic group (including salts thereof). Examples of organic groups include combined groups of a substituted or unsubstituted $C_{1-20}$ alkyl, $C_{1-20}$ alkenyl, $C_{7-20}$ aralkyl or $C_{6-20}$ aryl group and the above-mentioned group. Additionally, a combination of two or more of the combined groups may also be employed. For example, examples of such include dimethylaminoethyl group, aminoethyl group, diethylaminoethyl group, dibutylaminoethyl group, dibutylaminoethyl group, dimethylaminopropyl group in the form of hydrochloride, dimethylaminoethylthioethyl group, 4-dimethylaminophenyl group, 4-dimethylaminobenzyl group, methylthioethyl group, ethylthiopropyl group, 4-methylthio-3-cyanophenyl group, methylthiomethyl group, trimethylammonioethyl group, methoxyethyl group, methoxyethoxyethoxyethyl group, methoxyethylthioethyl group, 3,4-dimethoxyphenyl group, 3-chloro-4-methoxyphenyl group, morpholinoethyl group, 1-imidazolylethyl group, morpholinoethylthioethyl group, pyrrolidinoethyl group, pyrrolidinopropyl group, 2-pyridylmethyl group, 2-(1-imidazolyl)ethylthioethyl group, pyrazolylethyl group, triazolylethyl group, and methoxyethoxyethoxyethoxycarbonylaminoethyl group.

n represents 0 or 1; and m represents 0, 1 or 2.

In formula (III), L, $R^3$, n and M have the same meaning as in formula (II). p represents 1 or 2; and Q' represents an atomic group necessary for forming a 5-membered or 6-membered hetero ring which may form an imino silver. Preferably, Q' represents an atomic group necessary for forming a 5-membered or 6-membered hetero ring composed of atoms of carbon, nitrogen, oxygen, sulfur and/or selenium. The hetero ring may optionally be condensed with a carbocyclic-aromatic ring or a heterocyclic-aromatic ring. Examples of hetero rings formed by Q' are indazoles, benzimidazoles, benzotriazoles, benzoxazoles, benzothiazoles, imidazoles, thiazoles, oxazoles, triazoles, tetrazoles, tetrazaindenes, triazaindenes, diazaindenes, pyrazoles and indoles.

Of the compounds of the above-mentioned formula (II), those of the following formulae (IV), (V), (VI) and (VII) are preferably used in the present invention.

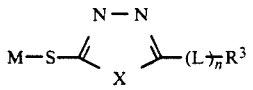

(IV)

where M, $R^3$, L and n have the same meaning as in formula (II); and X represents an oxygen atom, a sulfur atom or a selenium atom and is preferably an oxygen atom.

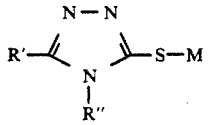

(V)

where

R' represents a hydrogen atom, a halogen atom (e.g., chlorine, bromine), a nitro group, a mercapto group, an unsubstituted $C_{1-30}$ amino group,-a substituted or unsubstituted $C_{1-30}$ alkyl group (e.g., methyl, ethyl), a substituted or unsubstituted $C_{1-30}$ alkenyl group (e.g., propenyl, 1-methylvinyl), a substituted or unsubstituted $C_{7-30}$ aralkyl group (e.g., benzyl, phenethyl), a substituted or unsubstituted $C_{6-30}$ aryl group (e.g., phenyl, 2-methylphenyl), or $-(L)_n-R^3$; R'' represents a hydrogen atom, unsubstituted amino group, or $-(L)_n-R^3$; when R' and R'40 are $-(L)_n-R^3$, they may be the same or different, provided that at least one of R' and R'' is $-(L)_n-R^3$; and M, $R^3$, L and n have the same meaning as in formula (II).

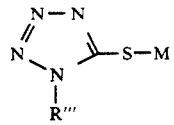

(VI)

where

R''' represents $-(L)_n-R^3$; and

M, $R^3$, L and n have the same meaning as in formula (II).

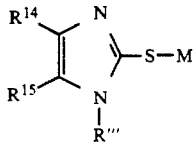

(VII)

where $R^{14}$ and $R^{15}$ each represents a hydrogen atom, a halogen atom, a substituted or unsubstituted $C_{1-20}$ amino group, a nitro group, or a substituted or unsubstituted $C_{1-30}$ alkyl, $C_{1-30}$ alkenyl, $C_{7-30}$ aralkyl or $C_{6-30}$ aryl group; and M and R'', have the same meaning as in formula (VI).

Specific examples of compounds of the formulae (III) to (VII) which can be used in the present invention are described below, which, however, are not intended to restrict the scope of the present invention.

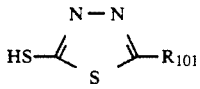

| No. | $R_{101}$ |
|---|---|
| A-1 | $-SCH_3$ |
| A-2 | $-S(CH_2)_3N(CH_3)_2.HCl$ |
| A-3 | 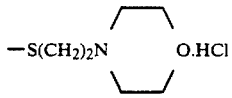 |
| A-4 | $-S(CH_2)_2OCH_3$ |
| A-5 | $-SCH_2SCH_3$ |
| A-6 | $-S(CH_2)_6N(CH_3)_2.HCl$ |
| A-7 | $-S(CH_2)_6N(C_2H_5)_2.HCl$ |
| A-8 | $-S(CH_2)_2S(CH_2)_2N(CH_3)_2.HCl$ |
| A-9 | 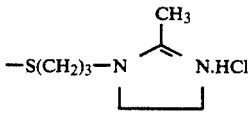 |
| A-10 | $-S(CH_2)_2\overset{\oplus}{N}(CH_3)_3.Cl^{\ominus}$ |
| A-11 | $-S(CH_2)_2NHCH_3.HCl$ |

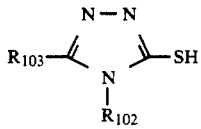

-continued

| No. | $R_{102}$ | $R_{103}$ |
|---|---|---|
| A-12 | 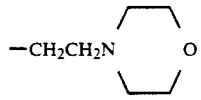 | H |
| A-13 | $-(CH_2)_3N(CH_3)_2$ | H |
| A-14 | 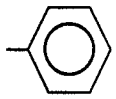 | H |
| A-15 | $-CH_2CH_2N(C_2H_5)_2$ | H |
| A-16 | $-CH_2CH_2N(CH_3)_2$ | H |
| A-17 | $-CH_3$ | $CH_3OCH_2-$ |
| A-18 | 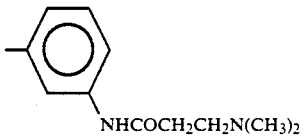 | H |
| A-19 | 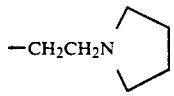 | H |
| A-20 | 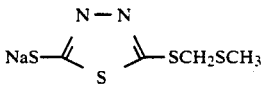 | |
| A-21 | 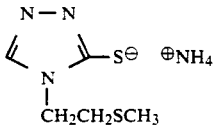 | |

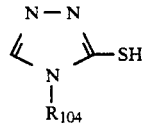

| No. | $R_{104}$ |
|---|---|
| A-22 | $-(CH_2)_2S(CH_2)_2N(CH_3)_2$ |
| A-23 | $-(CH_2)_2N(C_3H_7\text{-}n)_2$ |
| A-24 | $-(CH_2)_3N(CH_3)_2$ |
| A-25 | $-(CH_2)_2\overset{\oplus}{N}(CH_3)_3.Cl^{\ominus}$ |
| A-26 | 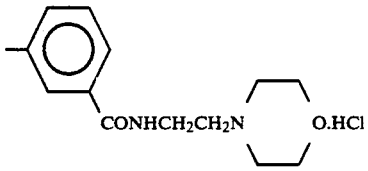 |

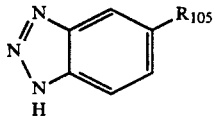

| No. | $R_{105}$ |
|---|---|
| A-27 | $-OCNH(CH_2)_2N(CH_3)_2$ |
| A-28 | $-OCNH(CH_2)_2SCH_3$ |

-continued

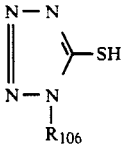

| No. | $R_{106}$ |
|---|---|
| A-29 | $\leftarrow CH_2)_3N(CH_3)_2$ |
| A-30 | $\leftarrow CH_2)_2N(C_3H_7\text{-}n)_2$ |
| A-31 | $\leftarrow CH_2)_2N(C_2H_5)_2$ |
| A-32 | $\leftarrow CH_2)_7O-CH_3$ |
| A-33 | 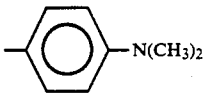 |
| A-34 | 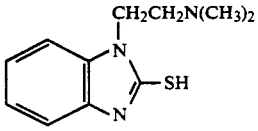 |

In accordance with the present invention, the compounds of the above-mentioned formulae (II) and (III) are incorporated into the photographic material. In particular, they are preferably incorporated into the internal latent image-type silver halide emulsion layers or other hydrophilic colloidal layers (interlayer, protective layer) of the material. Especially preferably, they are incorporated into the green-sensitive silver halide emulsion layer of the material.

The amount of the compound of formula (II) or (III) to be added is preferably from $10^{-6}$ to $10^{-2}$ mol, more preferably from $10^{-5}$ to $10^{-2}$ mol, per mol of silver halide.

Two or more compounds of formulae (II) and (III) may be incorporated into the material in combination, if desired.

The compounds of formulae (II) and (III) can be synthesized in accordance with, for example, *Advances in Heterocyclic Chemistry,* Vol. 9, pages 165 to 209 (1968), *Journal of Pharmaceutical Society Japan,* Vol. 71, pages 1481 to 1484 (1951), U.S. Pat. No. 2,823,208.

As the yellow coupler incorporated into the blue-sensitive emulsion layer of the photographic material of the present invention, compounds of the following general formula (Y—XI), which form coloring dyes similar to printing yellow inks in terms of the spectral absorption, are desired.

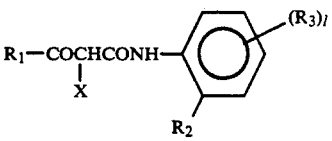

(Y-XI)

where $R_1$ represents an aryl group or a tertiary alkyl group;

$R_2$ represents a fluorine atom, an alkyl group, an aryl group, an alkoxy group, an aryloxy group, a dialkylamino group, an alkylthio group or an arylthio group;

$R^3$ represents a group which may a substituent on the benzene ring;

X represents a hydrogen atom or a group capable of being removed by a coupling reaction with the oxidation product of an aromatic primary amine developing agent;

l represents an integer of from 0 to 4;

provided that when l is plural number, the ($R_3$)'s may be the same or different.

Yellow couplers of formula (Y-XI) which can be used in the present invention are explained in greater detail below.

In formula (Y-XI), $R_1$ preferably represents an aryl group having from 6 to 24 carbon atoms (e.g., phenyl, p-tolyl, o-tolyl, 4-methoxyphenyl, 2-methoxyphenyl, 4-butoxyphenyl, 4-octyloxyphenyl, 4-hexadecyloxyphenyl, 1-naphthyl), or a tertiary alkyl group having from 4 to 24 carbon atoms (e.g., t-butyl, t-pentyl, t-hexyl, 1,1,3,3-tetramethylbutyl, 1-adamantyl, 1,1-dimethyl-2-chloroethyl, 2-phenoxy-2-propyl, bicyclo[2,2,2]octan-1-yl).

In formula (Y-XI), $R_3$ preferably represents a fluorine atom, an alkyl group having from 1 to 24 carbon atoms (e.g., methyl, ethyl, isopropyl, t-butyl, cyclopentyl, n-octyl, n-hexyl, benzyl), an aryl group having from 6 to 24 carbon atoms (e.g., phenyl, p-tolyl, o-tolyl, 4-methoxyphenyl), an alkoxy group having from 1 to 24 carbon atoms (e.g., methoxy, ethoxy, butoxy, n-octyloxy, n-tetradecyloxy, benzyloxy, methoxyethoxy), an aryloxy group having from 6 to 24 carbon atoms (e.g., phenoxy, p-tolyloxy, o-tolyloxy, p-methoxyphenoxy, p-dimethylaminophenoxy, m-pentadecylphenoxy), a dialkylamino group having from 2 to 24 carbon atoms (e.g., dimethylamino, diethylamino, pyrrolidino, piperidino, morpholino), an alkylthio group having from 1 to 24 carbon atoms (e.g., methylthio, butylthio, n-octylthio, n-hexadecylthio), or an arylthio group having from 6 to 24 carbon atoms (e.g., phenylthio, 4-methoxyphenylthio, 4-t-butylphenylthio, 4-dodecylphenylthio).

In formula (Y-XI) $R_3$ preferably represents a halogen atom (e.g., fluorine, chlorine, bromine, iodine), an alkyl group having from 1 to 24 carbon atoms (e.g., methyl, t-butyl, n-dodecyl), an aryl group having from 6 to 24 carbon atoms (e.g., phenyl, p-tolyl, p-dodecyloxyphenyl), an alkoxy group having from 1 to 24 carbon atoms (e.g., methoxy, n-butoxy, n-octyloxy, n-tetradecyloxy, benzyloxy, methoxyethoxy), an aryloxy group having from 6 to 24 carbon atoms (e.g., phenoxy, p-t-butylphenoxy, 4-butoxyphenoxy), an alkoxycarbonyl group having from 2 to 24 carbon atoms (e.g., ethoxycarbonyl, dodecyloxycarbonyl, 1-(dodecyloxycarbonyl) ethoxycarbonyl), an aryloxycarbonyl group having from 7 to 24 carbon atoms (e.g., phenoxycarbonyl, 4-t-octylphenoxycarbonyl, 2,4-di-t-pentylphenoxycarbonyl), a carbonamido group having from 1 to 24 carbon atoms (e.g., acetamido, pivaloylamino, benzamido, 2-ethylhexanamido, tetradecanamido, 1-(2,4-di-t-pentylphenoxy)-butanamido, 3-(2,4-di-phenylphenoxy)butanamido, 3-dodecylsulfonyl-2-methylpropanamido), a sulfonamido group having from 1 to 24 carbon atoms (e.g., methanesulfonamido, p-toluenesulfonamido, hexadecansulfonamido), a carbamoyl group having from 1 to 24 carbon atoms (e.g., N-methylcarbamoyl, N-tetradecylcarbamoyl, N,N-dihexylcarbamoyl, N-octadecyl-N-methylcarbamoyl, N-phenylcarbamoyl), a sulfamoyl group having up to 24 carbon atoms (e.g., N-methylsulfamoyl, N-phenylsulfamoyl, N-acetylsulfamoyl, N-propanoylsulfamoyl, N-hexadecylsulfamoyl, N,N-dioctylsulfamoyl), an alkylsulfonyl group having from 1 to 24 carbon atoms (e.g., methylsulfonyl, benzylsulfonyl, hexadecylsulfonyl), an arylsulfonyl group having from 6 to 24 carbon atoms (e.g., phenylsulfonyl, p-tolylsulfonyl, p-decylsulfonyl, p-methoxysulfonyl), a ureido group having from 1 to 24 carbon atoms (e.g., 3-methylureido, 3-phenylureido, 3,3-dimethylureido, 3-tetradecylureido), a sulfamoylamino group having up to 24 carbon atoms (e.g., N,N-dimethylsulfamoylamino), an alkoxycarbonylamino group having from 2 to 24 carbon atoms (e.g., methoxycarbonylamino, isobutoxycarbonylamino, dodecyloxycarbonylamino), a nitro group, a heterocyclic group having from 1 to 24 carbon atoms (e.g., 4-pyridyl, 2-thienyl, phthalimido, octadecylsuccinimido), a cyano group, an acyl group having from 1 to 24 carbon atoms (e.g., acetyl, benzoyl, dodecanoyl), an acyloxy group having from 1 to 24 carbon atoms (e.g., acetoxy, benzoyloxy, dodecanoyloxy), an alkylsulfonyloxy group having from 1 to 24 carbon atoms (e.g., methylsulfonyloxy, hexadecylsulfonyloxy), or an arylsulfonyloxy group having from 6 to 24 carbon atoms (e.g., p-toluenesulfonyloxy, p-dodecylphenylsulfonyloxy).

In formula (Y-XI), l preferably represents an integer of 1 or 2.

In formula (Y-XI), X preferably represents a group capable of being removed by a coupling reaction with the oxidation product of an aromatic primary amine developing agent (hereinafter referred to as a "removing group"). For example, X can be a halogen atom (e.g., fluorine, chlorine, bromine, iodine), a heterocyclic group which has from 1 to 24 carbon atoms and which is bonded to the coupling active position via the nitrogen atom, an aryloxy group having from 6 to 24 carbon atoms, an arylthio group having from 6 to 24 carbon atoms (e.g., phenylthio, p-t-butylphenylthio, p-chlorophenylthio, p-carboxyphenylthio), an acyloxy group having from 1 to 24 carbon atoms (e.g., acetoxy, benzoyloxy, dodecanoyloxy), an alkylsulfonyloxy group having from 1 to 24 carbon atoms (e.g., methylsulfonyloxy butylsulfonyloxy, dodecylsulfonyloxy), an arylsulfonyloxy group having from 6 to 24 carbon atoms (e.g., benzenesulfonyloxy, p-chlorophenylsulfonyloxy), or a heterocyclic-oxy group having from 1 to 24 carbon atoms (e.g., 3-pyridyloxy, 1-phenyl-1,2,3,4-tetrazol-5-yloxy). More preferably, it is a heterocyclic group which is bonded to the coupling active position via the nitrogen atom, or an aryloxy group.

Where X represents a nitrogen-containing heterocyclic group which is bonded to the coupling active position via the nitrogen atom, X is a 5-membered to 7-membered monocyclic or condensed heterocyclic group. Examples of hetero rings represented by X include succinimide, maleinimide, phthalimide, diglycolimido, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidin-2-one, oxazolin-2-one, thiazolin-2-one, benzimidazolin-2-one, benzoxazolin-2-one, benzothiazolin-2-one, 2-pyrrolin-5-one, 2-imidazolin-5-one, indoline-2,3-dione, 2,6-dioxypurine, parabanic acid, 1,2,4-triazolidine-3,5-dione, 2-pyridone, 4-pyridone, 2-pyrimidone, 6-pyridazone and 2-pyrazone rings. These heterocyclic groups may optionally be substituted. Examples of substituents which may be present on the heterocyclic groups are a hydroxyl group, a carboxyl group, a sulfo group, an amino group (e.g., unsubstituted amino, N-methylamino, N,N-dimethylamino, N,N-diethylamino, anilino, pyrrolidino, piperidino, morpholino), and the substituents which have been described hereinabove as examples of groups represented by $R_1$.

Where X represents an aryloxy group, it is preferably an aryloxy group having from 6 to 24 carbon atoms. Where X represents a heterocyclic group, it may optionally be substituted by substituent(s) selected from the above-described substituents. Preferably, the substituent on the heterocyclic group X is a carboxyl group, a sulfo group, a cyano group, a nitro group, an alkoxycarbonyl group, a halogen atom, a carbonamido group, a sulfonamido group, a carbamoyl group, a sulfamoyl group, an alkyl group, an alkylsulfonyl group, an arylsulfonyl group or an acyl group.

Next, especially preferred examples of the substituents $R_1$, $R_2$, $R_3$ and X are described below.

In formula (Y-XI), $R_1$ is especially preferably a 2- or 4-alkoxyaryl group (e.g., 4-methoxyphenyl, 4-butoxyphenyl, 2-methoxyphenyl), or a t-butyl group; and $R_1$ is most preferably a t-butyl group.

In formula (Y-XI), $R_2$ is especially preferably a methyl group, an ethyl group, an alkoxy group, an aryloxy group or a dialkylamino group; and $R_2$ is most preferably a methyl group, an ethyl group, an alkoxy group, an aryloxy group or a dimethylamino group.

In formula (Y-XI), $R_3$ is especially preferably an alkoxy group, an alkoxycarbonyl group, a carbonamido group or a sulfonamido group.

In formula (Y-XI), X is especially preferably a heterocyclic group which is bonded to the coupling active position via the nitrogen atom of the group, or an aryloxy group.

Where X represents the above-described heterocyclic group, X is preferably represented by the following general formula (Y-XII):

(Y-XII)

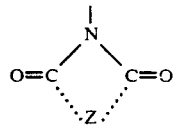

In formula (Y-XII), Z represents

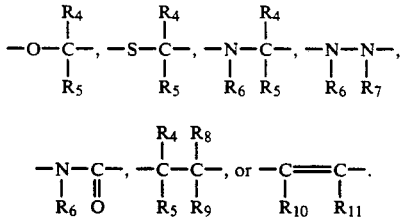

$R_4$, $R_5$, $R_8$ and $R_9$ each represents a hydrogen atom, an alkyl group, an aryl group, an alkoxy group, an aryloxy group, an alkylthio group, an arylthio group, an alkylsulfonyl group,. an arylsulfonyl group or an amino group; $R_6$ and $R_7$ each represents a hydrogen atom, an alkyl group, an aryl group, an alkylsulfonyl group, an arylsulfonyl group or an alkoxycarbonyl group; $R_{10}$ and $R_{11}$ each represents a hydrogen atom, an alkyl group or an aryl group. $R_{10}$ and $R_{11}$ may be bonded to each other to form a benzene ring. $R_4$ and $R_5$; $R_5$ and $R_6$; $R_6$ and $R_7$; or $R_4$ and $R_8$ may be bonded to each other to form a ring (for example, cyclobutane, cyclohexane, cycloheptane, cyclohexene, pyrrolidine, piperidine).

Of the heterocyclic groups represented by formula (Y-XII), especially preferred are those of formula (Y-XII) where Z is

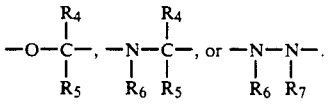

The heterocyclic group represented by formula (Y-XII) has from 2 to 24, preferably from 4 to 20, more preferably from 5 to 16 carbon atoms, in total. Examples of heterocyclic groups represented by formula (Y-XII) are a succinimido group, a maleinimido group, a phthalimido group, a 1-methylimidazolidin-2,4-dion-3-yl group, a 1-benzylimidazolidin-2,4-dion-3-yl group, a 5,5-dimethyloxazolidin-2,4-dion-3-yl group, a 5-methyl-5-propyloxazolidin-2,4-dion-3-yl group, a. 5,5-dimethylthiazolidin-2,4-dion-3-yl group, a 5,5-dimethylimidazolidin-2,4-dion-3-yl group, a 3-methylimidazolidinetrionyl-yl group, a 1,2,4-triazolidin-3,5-dion-4-yl group, a 1-methyl-2-phenyl-1,2,4-triazolidin-3,5-dion-4-yl group, a 1-benzyl-2-phenyl-1,2,4-triazolidin-3,5-dion-4-yl group, a 5-hexyloxy-1-methylimidazolidin-2,4-dion-3-yl group, a 1-benzyl-5-ethoxyimidazolidin-2,4-dion-3-yl group, and a 1-benzyl-5-dodecyloxyimidazolidin-2,4-dion-3-yl group.

Of the above-described heterocyclic groups, most preferred is an imidazolidin-2,4-dion-3-yl group (e.g., 1-benzyl-imidazolidin-2,4-dion-3-yl group).

Where X represents an aryloxy group, most preferred examples thereof are a 4-carboxyphenyl group, a 4-methylsulfonylphenoxy group, a 4-(4-benzyloxyphenylsulfonyl)phenoxy group, a 4-(4-hydroxyphenylsulfonyl) phenoxy group, a 2-chloro-4-(3-chloro-4-hydroxyphenylsulfonyl)phenoxy group, a 4-methoxycarbonylphenoxy group, a 2-chloro-4-methoxycarbonylphenoxy group, a 2-acetamido-4-methoxycarbonylphenoxy group, a 4-isopropoxycarbonylphenoxy group, a 4-cyanophenoxy group, a 2-[N-(2-hydroxyethyl)carbamoyl]phenoxy group, a 4-nitrophenoxy group, a 2,5-dichlorophenoxy group, a 2,3,5-trichlorophenoxy group, a 4-methoxycarbonyl-2-methoxyphenoxy group, and a 4-(3-carboxypropanamido)phenoxy group.

Couplers of the formula (Y-XI) may form dimers or higher polymers where two or more couplers are bonded together at the position of the substituent of $R_1$, X or

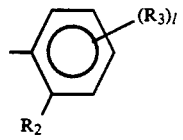

via a divalent or a higher polyvalent group. The limitation on the number of the carbon atoms of each of the above-described substituents does not apply in the case.

Where couplers of the formula (Y-XI) form polymers, typical examples thereof are homopolymers or copolymers of yellow dye-forming coupler residue-containing adduct polymer-forming ethylenic unsaturated compounds (yellow coloring monomers). In this case, the polymers contain a repeating unit of the following general formula (Y-XIII) and may contain one or more yellow-coloring repeating units of the formula (Y-XI) in the polymer molecule. The polymers may also be copolymers which contain one or more non-coloring ethylenic monomers as a copolymerizing component.

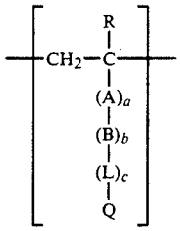

where

R represents a hydrogen atom, an alkyl group having from 1 to 4 carbon atoms, or a chlorine atom;

A represents —CONH—, —COO—, or a substituted or unsubstituted phenylene group;

B represents a substituted or unsubstituted alkylene, phenylene or aralkylene group;

L represents —CONH—, —NHCONH—, —NHCOO—, —NHCO—, —OCONH—, —NH—, —COO—, —OCO—, —CO—, —O—, —S—, $—SO_2—$, $—NHSO_2—$ or $—SO_2NH—$;

a, b and c each represent 0 or 1; and

X represents an yellow coupler of the formula (Y-XI) where one hydrogen atom has been removed from $R_1$, X or

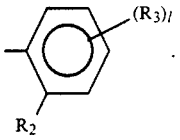

Preferred polymers are copolymers composed of the yellow-coloring monomer represented by the coupler unit of the formula (Y-XIII) and a non-coloring ethylenic monomer, examples of which are mentioned below.

Examples of non-coloring ethylenic monomers which do not couple with the oxidation product of an aromatic primary amine developing agent and which can be used in the present invention for the above-mentioned purpose include acrylic acid, α-chloroacrylic acid, α-alkylacrylic acids (e.g., methacrylic acid), and amides and esters derived from acrylic acids (e.g., acrylamide, methacrylamide, n-butylacrylamide, t-butylacrylamide, diacetonacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxy methacrylate), vinyl esters (e.g., vinyl acetate, vinyl propionate and vinyl laurate), acrylonitrile methacrylonitrile, aromatic vinyl compounds (e.g., styrene, and derivatives thereof such as vinyl toluene, divinylbenzene, vinylacetophenone and sulfostyrene), itaconic acid, citraconic acid, crotonic acid, vinylidene chloride, vinyl alkyl ethers (e.g., vinyl ethyl ether), maleates, N-vinyl-2-pyrrolidone, N-vinylpyridine and 2- and 4-vinylpyridines.

In particular, acrylates, methacrylates and maleates are preferred. In preparing these copolymers, two or more non-coloring ethylenic monomers may be used in combination, if desired. For instance, methyl acrylate and butyl acrylate; butyl acrylate and styrene; butyl methacrylate and methacrylic acid; as well as methyl acrylate and diacetonacrylamide can be used.

As is well known in the field of polymer couplers, ethylenic unsaturated monomers copolymerized with vinyl monomers which correspond to the above-mentioned formula (Y-XIII) may be so selected that they advantageously influence the physical properties and/or chemical properties of the copolymers formed, for example, solubility, compatibility with binders (e.g., gelatin) as to photographic colloidal compositions, flexibility and heat-stability thereof.

The yellow polymer coupler used in the present invention, which is an oleophilic polymer coupler obtained by polymerization of the vinyl monomer to give the coupler unit of formula (Y-XIII), may be dissolved in an organic solvent and the resulting solution may be dispersed by emulsification in an aqueous gelatin solution as a latex. Alternatively, the polymer coupler may also be prepared by direct emulsion polymerization.

The method described in U.S. Pat. No. 3,451,820 may be referred to as to the method of dispersing the oleophilic polymer coupler in an aqueous gelatin solution as a latex. The methods described in U.S. Pat. Nos. 4,080,211 and 3,370,952 may be referred to as to emulsion polymerization.

Examples of groups $R_3$ and X in the yellow dye-forming couplers of formula (Y-XI) are described below, which, however, are not whatsoever intended to restrict the scope of the present invention.

Examples of X are as follows:

(1)

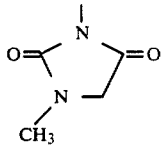

(2)

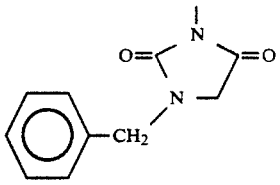

(3)

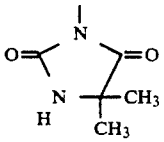

(4)

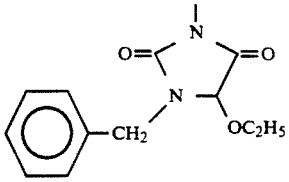

-continued
(5)
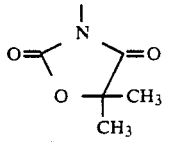
(6)
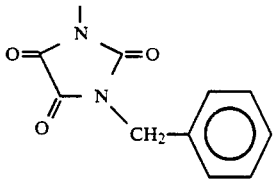
(7)
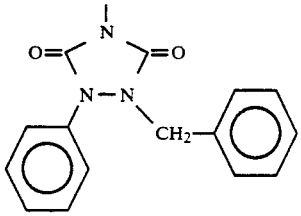
(8)
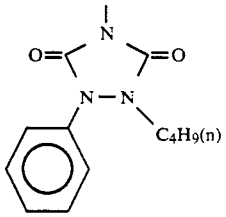
(9)
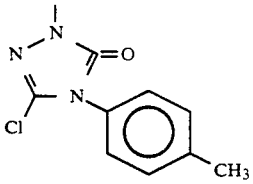
(10)
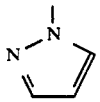
(11)
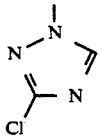
(12)
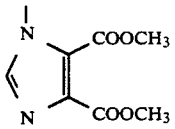
(13)
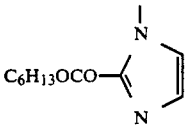
-continued
(14)
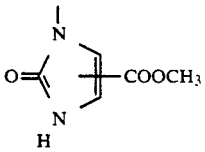
(15)
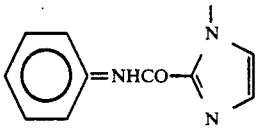
(16)
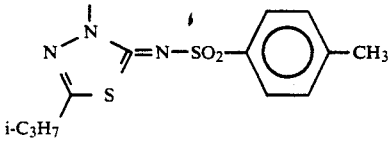
(17)
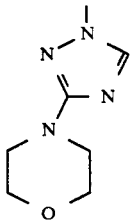
(18)
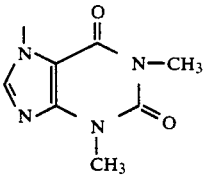
(19)
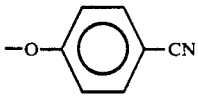
(20)
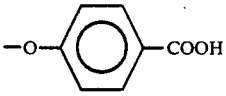
(21)
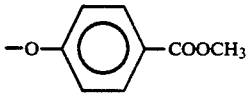
(22)
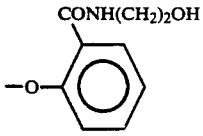
(23)
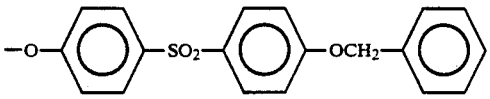

-continued (24)

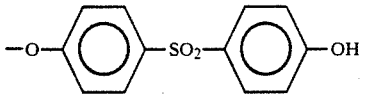

(25)

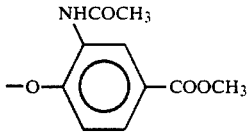

Examples of $R_3$ are as follows:

(30) $-NHCOC_{13}H_{27}$-n (31)

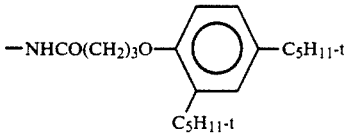

(32)

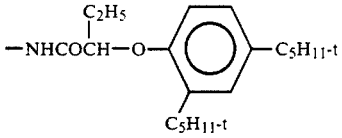

(33) $-NHCOCH(CH_3)CH_2SO_2C_{12}H_{25}$ (34)

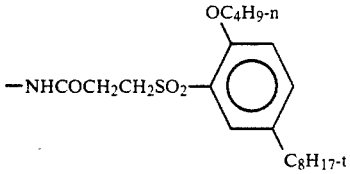

(35) $-OC_{16}H_{33}$-n

(36) $-NHCOCH(C_6H_{13})C_8H_{17}$-n

(37) $-NHCOCH((CH_2)_2CH(CH_3)CH_2C_4H_9\text{-}t)CH_2C_4H_9\text{-}t$

(38) $-NHCOCH_2CH(C_{18}H_{27})COOCH_3$

(39) $-NHSO_2C_{12}H_{25}$-n

(40) $-NHSO_2C_{16}H_{33}$-n (41)

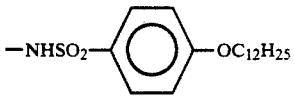

(42) $-COOC_{12}H_{25}$

(43) $-COOCH(CH_2)COOC_{12}H_{25}$

(44) $-CONHC_{14}H_{29}$

-continued

(45) $-OC_8H_{17}$-n (46)

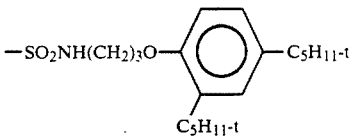

(47) $-CONH(CH_2)_3OC_{12}H_{25}$

(48) $-NHCOC_{15}H_{31-n}$

(49) $-COOC_{14}H_{29}$-n

Specific examples of yellow dye-forming couplers of the formula (Y-XI) are described below, with reference to the substituents in the following structural formula.

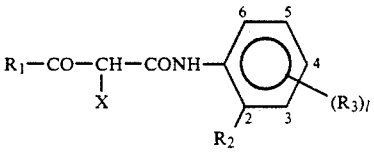

| No. | $R_1$ | $R_2$ | $(R_3)_l$ | X |
|---|---|---|---|---|
| Y-101 | t-$C_4H_9$— | —$OCH_3$ | (32) [5] | (4) |
| Y-102 | t-$C_4H_9$— | —$CH_3$ | (32) [5] | (4) |
| Y-103 | t-$C_4H_9$— | —$C_2H_5$ | (31) [5] | (2) |
| Y-104 | t-$C_4H_9$— | 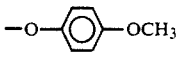 | (32) [5] | (5) |
| Y-105 | t-$C_4H_9$— | 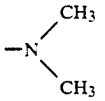 | (32) [5] | (4) |
| Y-106 | t-$C_4H_9$— | —$OCH_3$ | (33) [5] | (2) |
| Y-107 | t-$C_4H_9$— | —$OC_2H_5$ | (33) [5] | (7) |
| Y-108 | t-$C_4H_9$— | —$OCH_3$ | (31) [5] | (23) |
| Y-109 | t-$C_4H_9$— | 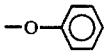 | (40) [5] | (19) |
| Y-110 | t-$C_4H_9$— | —$OC_8H_{17-n}$ | (45) [4] | (5) |
| Y-111 | t-$C_4H_9$— | —$OC_8H_{17-n}$ | (45) [5] | (5) |
| Y-112 | t-$C_4H_9$— | —$CH_3$ | (32) [4] | (4) |
| Y-113 | t-$C_4H_9$— | 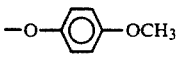 | (30) [5] | (10) |
| Y-114 | t-$C_4H_9$— | —$OC_{16}H_{33-n}$ | — | (15) |
| Y-115 | t-$C_4H_9$— | —$OCH_2CH_2OCH_3$ | (34) [5] | (8) |
| Y-116 | t-$C_4H_9$— | —$CH_3$ | (43) [5] | (9) |
| Y-117 | t-$C_4H_9$— | —$C_2H_5$ | (47) [5] | (8) |
| Y-118 | t-$C_4H_9$— | —$OCH_3$ | (46) [5] | (2) |
| Y-119 | t-$C_4H_9$— | —$OC_8H_{17-n}$ | (45) [4], (45) [5] | (5) |
| Y-120 | t-$C_4H_9$— | —$OCH_3$ | (31) [5] | (19) |
| Y-121 | t-$C_4H_9$— | 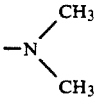 | (36) [4] | (18) |
| Y-122 | t-$C_4H_9$— | 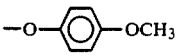 | (41) [5] | (11) |
| Y-123 | t-$C_4H_9$— | 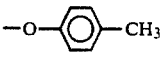 | (37) [5] | (3) |

-continued

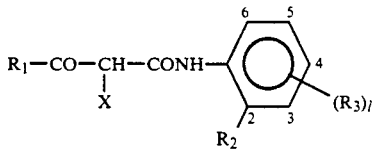

| No. | $R_1$ | $R_2$ | $(R_3)_l$ | X |
|---|---|---|---|---|
| Y-124 | t-$C_4H_9$— | —$OC_2H_5$ | (37) [5] | (1) |
| Y-125 | t-$C_4H_9$— | —$CH_3$ | (38) [5] | (2) |
| Y-126 | t-$C_4H_9$— | —$C_2H_5$ | (38) [5] | (2) |
| Y-127 | t-$C_4H_9$— | —$CH_3$ | (33) [5] | (2) |
| Y-128 | 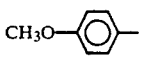 | —$OCH_3$ | (42) [5] | (4) |
| Y-129 | 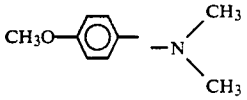 |  | (40) [5] | (4) |
| Y-130 | 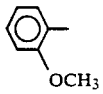 | —$CH_3$ | (43) [5] | (2) |
| Y- 31 | t-$C_4H_9$— | —$OCH_3$ | (42) [5] | (5) |
| Y- 32 | t-$C_4H_9$— | —$CH_3$ | (42) [5] | (5) |
| Y- 33 | t-$C_4H_9$— | —$OCH_3$ | (48) [5] | (5) |
| Y- 34 | t-$C_4H_9$— | —$OCH_3$ | (48) [5] | (4) |
| Y- 35 | t-$C_4H_9$— | —$OCH_3$ | (49) [5] | (5) |
| Y- 36 | t-$C_4H_9$— | —$CH_3$ | (49) [5] | (5) |
| Y- 37 | t-$C_4H_9$— | —$OCH_3$ | (33) [5] | (8) |

In the table above, the number in ( ) corresponds to the number given to examples of X and $R_3$ illustrated hereinbefore; and the number in [ ] indicates the position of the substituent on the anilide group.

The yellow dye-forming couplers of the present invention may be used alone or as a combination of two or more of them, or they may be employed along with other known yellow dye-forming couplers within an amount the effect of the present invention is slitt displayed.

The yellow dye-forming couplers used in the present invention can be incorporated in any layer of a photographic material, but preferably they are incorporated into light-sensitive silver halide emulsion layers or into the adjacent layers, most preferably into light-sensitive silver halide emulsion layers.

The yellow dye-forming couplers used in the present invention can be produced using known conventional methods, for example, using the methods described in JP-A-63-123047 (the term "JP-A" as used herein means an "unexamined published Japanese patent application).

The amount of the yellow dye-forming coupler used in the photographic material of the present invention is from $1\times10^{-5}$ mol to $10^{-2}$ mol, preferably from $1\times10^{-4}$ mol to $5\times10^{-3}$ mol, more preferably from $2\times10^{-4}$ mol to $10^{-3}$ mol, per $m^2$ or the material.

Either a light-fogging method or a chemical method can be employed in obtaining direct positive image in the present invention.

At least one of compounds of the following general formulae (N-I) and (N-II) is preferred as a nucleating agent which is used in the present invention.

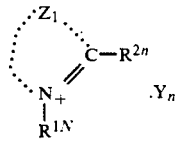

(N-I)

In formula (N-I), $Z_1$ represents a non-metallic atomic group necessary for forming a 5-membered or 6-membered heterocyclic group; $R^{1N}$ represents an aliphatic group; and $R^{2N}$ represents a hydrogen atom, an aliphatic group or an aromatic group. $Z_1$, $R^{1N}$ and $R^{2N}$ may optionally be substituted; and $R^{2N}$ may be bonded to the hetero ring formed by $Z_1$ to from a ring. However, at least one of $R^{1N}$, $R^{2N}$ and $Z_1$ must contain an alkynyl group, an acyl group, a hydrazine group or a hydrazone group; or $R^{1N}$ and $R^{2N}$ form a 6-membered ring comprising dihydropyridinium skeleton. Y represents a pair ion for charge balance of the molecule; and n represents 0 or 1.

More precisely, the hetero ring completed by $Z_1$ includes, for example, quinoxalinium, benzothiazolium, benzimidazolium, pyridinium, thiazolinium, thiazolium, naphthothiazolium, selenazolium, benzoselenazolium imidazolium, tetrazolium, indolenium, pyrrolinium, acridinium, phenanthridinium, isoquinolinium, oxazolium, naphthoxazolium and benzoxazolium nuclei. Examples of substituents which may be in the group $Z_1$, are a $C_{1-8}$ alkyl group, a $C_{2-10}$ alkenyl group, a $C_{7-16}$ aralkyl group, a $C_{6-15}$ aryl group, a $C_{2-10}$ alkynyl group, a hydroxyl group, a $C_{1-8}$ alkoxy group, a $C_{6-15}$ aryloxy group, a halogen atom, a $C_{0-16}$ amino group, a $C_{1-8}$ alkylthio group, a $C_{6-15}$ arylthio group, a $C_{1-9}$ acyloxy group, an $C_{1-9}$ acylamino group, a $C_{1-8}$ sulfonyl group, a $C_{1-8}$ sulfonyloxy group, a $C_{0-8}$ sulfonylamino group, a carboxyl group, a $C_{1-9}$ acyl group, a $C_{1-8}$ Carbamoyl group, a $C_{0-8}$ sulfamoyl group, a sulfo group, a cyano group, a $C_{1-10}$ ureido group, a $C_{1-10}$ urethane group, a $C_{1-10}$ carbonate group, a $C_{0-10}$ hydrazine group, a $C_{0-10}$ hydrazone group and a $C_{0-10}$ imino group. Suitable substituent(s) present in the group Z include at least one selected from the above-mentioned substituents. Where the group Z has two or more substituents, the substituents may be the same or different. Additionally, the above-mentioned substituents may further be substituted by any of the above substituents.

Further, another example of the substituent present in the group $Z_1$ include a heterocyclic quaternay ammonium group completed by $Z_1$ via a appropriate linking group L. In this case, the compound is said to have a so-called dimer structure.

Examples of heterocyclic groups completed by the group $Z_1$ are preferably quinolinium, benzothiazolium, benzimidazolium, pyridinium, acridinium, phenanthridinium and isoquinolinium nuclei. More preferred are quinolinium and benzothiazolium nuclei; and most preferred is a quinolinium nucleus.

The aliphatic group represented by $R^{1N}$ or $R^{2N}$ is preferably an unsubstituted alkyl group having from 1 to 18 carbon atoms, or a substituted alkyl group in which the alkyl moiety has from 1 to 18 carbon atoms. Examples of substituents present in the substituted alkyl group include the same substituents as described above for $Z_1$. Additionally, $R^{2N}$ may be bonded to the hetero ring completed by $Z_1$ to form a ring.

The aromatic group represented by $R^{2N}$ is preferably one having from 6 to 20 carbon atoms, which includes, for example, a phenyl group and a naphthyl group. Examples of substituents in the aromatic group include the substituents for the group $Z_1$ described above. Preferably, $R^{2N}$ is an aliphatic group; and most preferably, it is a methyl group, a substituted methyl group, or a group bonded to the hetero ring completed by the group $Z_1$ to form a ring.

At least one of the groups $R^{1N}$, $R^{2N}$ and Z has an alkynyl group, an acyl group, a hydrazine group or a hydrazone group; or $R^{1N}$ and $R^{2N}$ form a 6-membered ring to complete a dihydropyridinium skeleton. These may optionally be substituted by substituents, for example, those as described above as substituents of -the group $Z_1$.

In accordance with the present invention, preferred is the case where at least one of $R^{1N}$, $R^{2N}$ and $Z_1$ or at least one of the substituents on the 6-membered ring formed by $R^{1N}$ and $R^{2N}$ is an alkynyl group or an acyl group, or the case where $R^{1N}$ and $R^{2N}$ are bonded to form a dihydropyridinium skeleton. More preferably, the compound contains at least one alkynyl group, most preferably at least one propargyl group.

A group of the formula $X^1$—$(L^1)_m$— is preferred, in which $X^1$ represents a silver halide adsorptionaccelerating group, $L^1$ represents a divalent linking group, and m represents 0 or 1 as the silver halide adsorption-accelerating group which may be in the Substituents of $R^{1N}$, $R^{2N}$ and $Z_1$.

Preferred examples of silver halide adsorption-accelerating groups represented by $X^1$ include a thioamido group, a mercapto group and a 5-membered or 6-membered heterocyclic group.

These groups may optionally be substituted by substituents, for example, those as described with respect to the substituents of the group $Z_1$. The thioamido group is preferably a non-cyclic thioamido group (for example, a thiourethane group or a thioureido group).

A heterocyclic mercapto group is especially preferred as the mercapto group represented by $X^1$ with examples, including 5-mercaptotetrazole, 3-mercapto-1,2,4-triazole, 2-mercapto-1,3,4-thiadiazole, and 2-mercapto-1,3,4-oxadiazole.

The 5-membered or 6-membered nitrogen-containing heterocyclic group as represented by $X^1$ is composed of nitrogen, oxygen, sulfur and carbon atoms. Preferably, it is to form an imino silver, for example, including a benzotriazole and an aminothiatriazole.

The divalent linking group as represented by $L^1$ is an atom or an atomic group containing at least one of C, N, S and O atoms. Specifically, examples include a $C_{1-10}$ alkylene group, a $C_{1-10}$ alkenylene group, a $C_{2-10}$ alkynylene group, a $C_{6-15}$ arylene group, —O—, —S—, —NH—, —N=, —CO— and —$SO_2$—, as well as a combination of two or more of these groups. The groups may optionally be substituted. Examples of preferred combinations of these groups are $$-\overset{O}{\overset{\|}{C}}-,\ -\overset{O}{\overset{\|}{C}}NH-,\ -SO_2NH-,\ -\overset{O}{\overset{\|}{C}}NH-,\ -\overset{O}{\overset{\|}{C}}NHCNH-,$$

$$-NHSO_2NH-,\ \text{-(alkylene)-}\overset{O}{\overset{\|}{C}}NH-,\ \text{-(arylene)-}SO_2NH-,$$

$$\text{-(arylene)-}\overset{O}{\overset{\|}{C}}NHCONH-\ \text{and}\ \text{-(arylene)-}\overset{O}{\overset{\|}{C}}NH-.$$

Examples of the pair ion Y for charge balance are, for example, bromide ion, chloride ion, iodide ion, p-toluenesulfonate ion, ethylsulfonate ion, perchlorate ion, trifluoromethanesulfonate ion, thiocyan ion, boron tetrafluoride ion and phosphorus hexafluoride ion.

These compounds and methods of their preparation are described, for example, in patent publications referred to in *Research Disclosure*, No. 22543 (issued on January, 1983, pages 50 to 54) and No. 23213 (issued on August, 1983, pages 267 to 270), as well as in JP-B-49-38164, JP-B-52-19452 and JP-B-52-47326, JP-A-52-69613, JP-A-52-3426, JP-A-55-138742 and JP-A-60-11827, and U.S. Pat. Nos. 4,306,016 and 4,471,044.

$$R^{3N}-\underset{\underset{R^{5N}}{|}}{N}-\underset{\underset{R^{6N}}{|}}{N}-G-R^{4N} \qquad \text{(N-II)}$$

In formula (N-II), $R^{3N}$ represents an aliphatic group, an aromatic group, or a heterocyclic group; $R^{4N}$ represents a hydrogen atom, an alkyl group, an aralkyl group, an aryl group, an alkoxy group, an aryloxy group or an amino group; G represents a carbonyl group, a sulfonyl group, a sulfoxy group, a phosphoryl group or an iminomethylene group (HN=C=); and both $R^{5N}$ and $R^{6N}$ are hydrogen atoms, or one of them represents a hydrogen atom and the other represents an alkylsulfonyl group, an arylsulfonyl group or an acyl group. G, $R^{4N}$ and $R^{6N}$ may form, together with the hydrazine nitrogen atoms, a hydrazone structure (=N—N=C=). The above-mentioned groups may optionally be substituted by substituent(s), if possible.

More particularly, $R^{3N}$ may be substituted by a substituent, which in turn may be further substituted, such as an alkyl group, an aralkyl group, an alkoxy group, an amino group substituted by an alkyl or aryl group, an acylamino group, a sulfonylamino group, a ureido group, a urethane group, an aryloxy group, a sulfamoyl group, a carbamoyl group, an aryl group, an alkylthio group, an arylthio group, a sulfonyl group, a sulfinyl group, a hydroxy group, a halogen atom, a cyano group, a sulfo group and a carboxyl group, with a ureido group or sulfonamido group preferred, which groups may link together to form a ring, if possible.

Preferably, $R^{3N}$ represents an aromatic group, an aromatic heterocyclic ring group or an aryl-substituted methyl group, with an aryl group (e.g., a phenyl group and a naphthyl group) more preferred.

Preferably, $R^{4N}$ represents a hydrogen atom, an alkyl group (e.g., a methyl group) or an aralkyl group (e.g., an o-hydroxybenzyl group), with a hydrogen atom particularly preferred.

The substituents for $R^{4N}$ include those for $R^{3N}$ as well as an acyl group, an acyloxy group, an alkyloxycarbonyl group, an aryloxycarbonyl group, an alkenyl group, an alkynyl group and a nitro group, which may be further substituted any of those substituents, and, if possible, may link together to form a ring.

$R^{3N}$ or $R^{4N}$, in particular $R^{3N}$, may contain a diffusion-resistant group such as a coupler, ballast group (preferably linked through a ureido group) and may contain a group $X^2$—$(L^2)$—$m^2$ capable of accelerating adsorption onto the surface of silver halide grains, where $X^2$ has the same meaning as $X^1$ in general formula (N-I) and preferably represents a thioamide group (excluding a thiosemicarbazide and its substitution product), a mercapto group or a 5- or 6- membered nitrogen-containing heterocyclic ring group, $L^2$ represents a divalent liking group and has the same meaning as $L^1$ in general formula (N-I), and $m^2$ is 0 or 1.

Preferably, $X^2$ represents a non-cyclic thioamido group (e.g., a thioureido group and a thiourethane group), a cyclic thioamido group (i.e., a mercapto-substituted nitrogen-containing heterocyclic ring, e.g., a 2-mercaptothiadiazole group, a 3-mercapto-1,2,4-triazole group, a 5-mercaptotetrazole group, a 2-mercapto-1,3,4-oxadiazole group and a 2-mercaptobenzoxazole group)or a nitrogen-containing heterocyclic ring group (e.g., a benzotriazole group, benzimidazole group and an indazole group).

Most preferably $X^2$ is determined based on the photosensitive material. For example, in the case of a color photosensitive material that uses a coloring material (a so-called coupler) that forms a dye when coupled with the oxidation product of a p-phenylenediamine type developing agent, $X^2$ preferably represents a mercapto-substituted nitrogen-containing heterocyclic ring or a nitrogen-containing heterocyclic ring that will form an imino silver. In the case of a color photosensitive material that uses a coloring material (a so-called DRR compound) that forms a diffudion-resistant dye by cross-oxidizing the oxidation product of a developing agent, $X^2$ preferably represents a non-cyclic thiamido group or a mercapto-substituted nitrogen-containing heterocyclic ring. In the case of a black-and-white photosensitive material, $X^2$ preferably represents a mercapto-substituted nitrogen-containing heterocyclic ring or a nitrogen-containing heterocyclic ring that will form an imino silver.

Most preferably, $R^{5N}$ and $R^{6N}$ represent a hydrogen atom.

Most preferably, G in general formula (N-II) represents a carbonyl group.

Preferably, the compound represents by general formula (N-II) contains a group capable of being absorbed onto a silver halide or a group having a ureido group.

Particularly, examples of hydrazine type nucleating agents having a group capable of being absorbed onto a silver halide, and synthetic methods therefor and described, for example, in U.S. Pat. Nos. 4,030,925, 4,080,207, 4,031,127, 3,718,470, 4,269,929, 4,276,364, 4,278,748, 4,385,108, 4,459,928, and 4,560,638, British Patent 2,011,391B and JP-A-54-74729, JP-A-55-163533, JP-A-55-74536, and JP-A-60-179734.

Examples of other hydrazine type nucleating agents and synthetic methods therefor are described, for example, in JP-A-57-86829, U.S. Pat. Nos. 4,560,638, 4,478,528, 2,563,785 and 2,588,982.

Specific examples of compounds of the formula (N-I) are described below, which, however, do not whatsoever restrict the scope of the present invention.

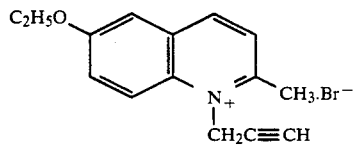

(N-1-1)

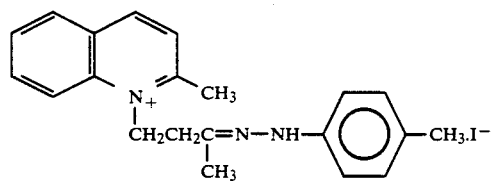

(N-1-2)

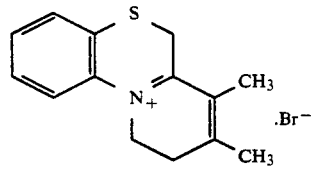

(N-1-3)

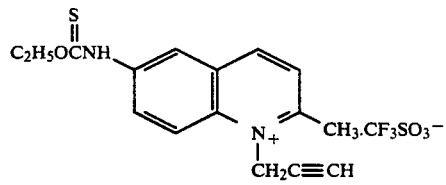

(N-1-4)

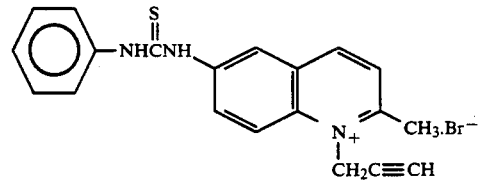

(N-1-5)

-continued
(N-1-6)
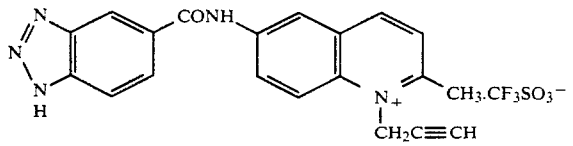
(N-1-7)
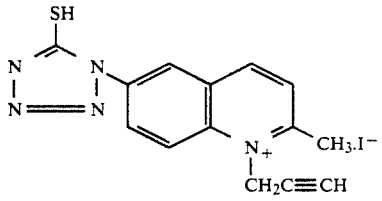
(N-1-8)
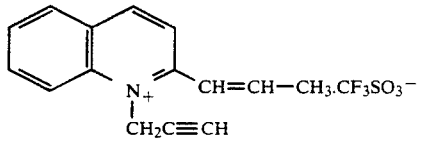
(N-1-9)
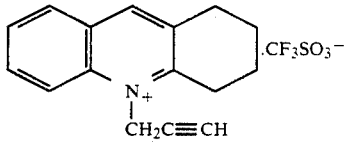
(N-1-10)
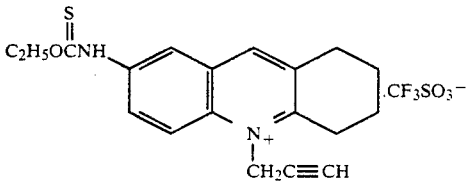
(N-1-11)
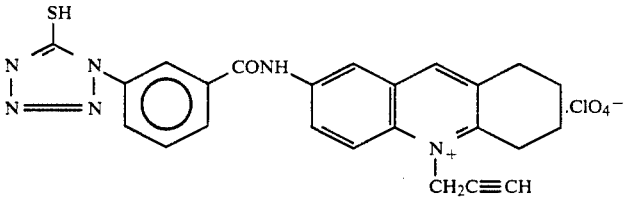
(N-1-12)
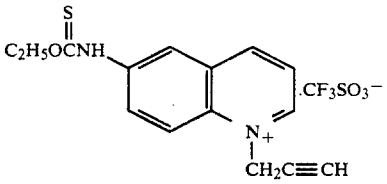
(N-1-13)
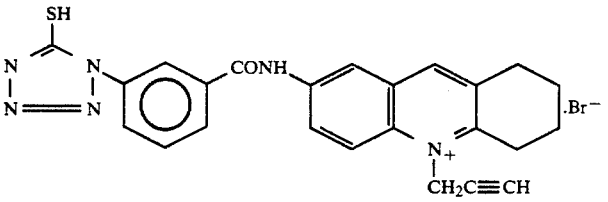
(N-1-14)
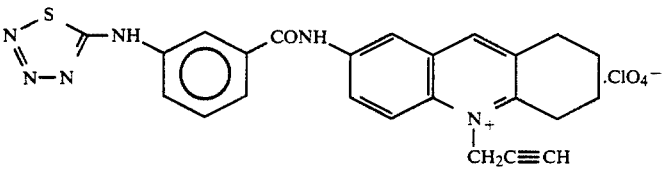

-continued (N-1-15)

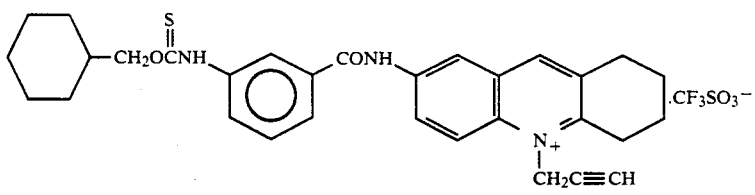

(N-1-16)

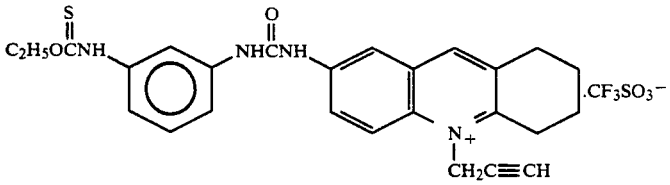

(N-1-17)

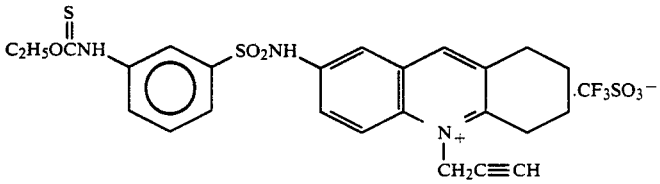

(N-1-18)

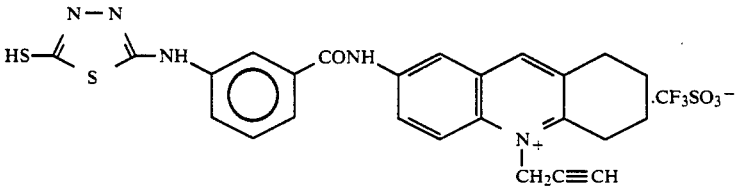

(N-1-19)

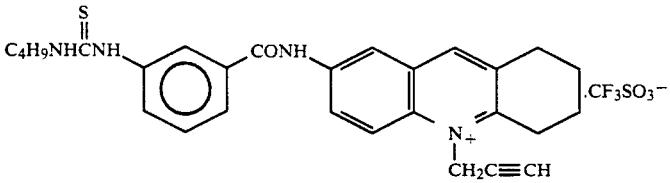

(N-I-20)

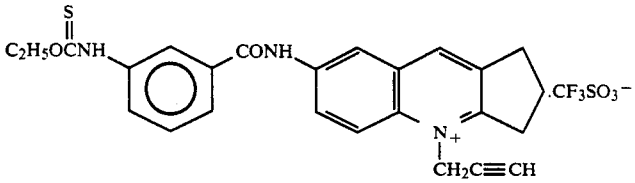

In the present invention, the nucleating agent of the formula (N-I) or (N-II) may be incorporated into the hydrophilic colloid layer adjacent a -silver halide emulsion layer of the photographic material of the invention, but it is preferably incorporated into a silver halide emulsion layer. The amount of the agent to be added to the layer may vary over a broad range, depending upon the characteristics of the silver halide emulsion actually used, the chemical structure of the nucleating agent and the conditions of development of the photographic material. Generally, however, the amount is from about $1\times10^{-8}$ mol to $1\times10^{-2}$ mol, preferably from about $1\times10^{-7}$ to $1\times10^{-3}$ mol, per mol of silver in the silver halide emulsion.

Compounds of formula (N-I) are preferred as nucleating agents for use in the present invention. Above all, more preferred are those of the formula (N-I) where $R^{2N}$ is bonded to the hetero ring completed by $Z_1$ to form a ring.

The previously non-fogged internal latent image-type silver halide emulsion for use in the present invention is an emulsion containing silver halide grains, the surfaces of which are not previously fogged and which form a latent image essentially in the inside of the grains. More specifically, the emulsion may be identified as follows. A silver halide emulsion to be evaluated is coated on a transparent support in a specific amount (0.5 to 3 g/m$^2$), this is exposed for a specific period of from 0.01 second to 10 seconds and then developed with the following developer (A) (internal developer) at 18° C. for 5 minutes, and the maximum density of the image formed is determined by conventional photographic densitometry. On the other hand, the same silver halide emulsion is coated on the same support in the same manner as above and then exposed also in the same manner as above. The thus exposed material is then developed with the following developer (B) (surface developer) at 20° C. for 6 minutes and the maximum density of the image formed is determined also in the same manner as above. When the value of the maximum density obtained in the former (developed with the internal developer (A)) is at least 5 times, more preferably at least 10 times, of that obtained in the latter (developed with the surface developer (B), the emulsion tested is an internal latent image-type emulsion.

| | |
|---|---|
| Internal Developer (A): | |
| Metol | 2 g |
| Sodium sulfite (anhydride) | 90 g |
| Hydroquinone | 8 g |
| Sodium carbonate (monohydrate) | 52.5 g |
| KBr | 5 g |
| KI | 0.5 g |
| Water to make | 1 l |
| Surface Developer (B): | |
| Metol | 2.5 g |
| L-Ascorbic acid | 10 g |
| $NaBO_2.4H_2O$ | 35 g |
| KBr | 1 g |
| Water to make | 1 l |

Examples of internal latent image-type emulsions, for example, include conversion-type silver halide emulsions as described in U.S. Pat. No. 2,592,250, as well as core/shell type silver halide emulsions as described in U.S. Pat. Nos. 3,761,276, 3,850,637, 3,923,513, 4,035,185, 4,395,478 and 4,504,570, JP-A-52-56614, JP-A-55-127549, JP-A-53-60222, JP-A-56-22681, JP-A-59-208540, JP-A-60-107641, JP-A-61-3137 and JP-A-62-215272 and the patent publications as mentioned in *Research Disclosure* No. 23510 (issued in November, 1983), page 236.

The internal latent image-type silver halide grains which are used in the present invention may be either in the form of a conversion-type emulsion or in the form of a core/shell type emulsion, but preferably they have a core/shell laminate structure as a result of the case in controlling photographic sensitivity and in view of the gradation of the emulsion. The core and shell structure of the core/shell silver halide grains, are preferably composed of silver bromide, silver iodobromide or silver chloroiodobromide which consists of silver bromide and 10 mol % or less, preferably 3 mol % or less silver iodide, or are composed of silver chloride or silver chlorobromide. The core may be either a so-called conversion type core or a general grain. The halogen composition of the core and that of the shell may be the same or different. Examples of core/shell type structure silver halide emulsions, for example, are those as described in JP-A-55-127549, U.S. Pat. No. 4,395,478 and West German Patent 2,322,802.

The silver halide grains for use in the present invention can contain manganese, copper, zinc, cadmium, lead, bismuth or a metal of the Group VIII of the Periodic Table, and the amount of the metal in the grains may be from $10^{-9}$ to $10^{-2}$ mol, preferably from $10^{-6}$ to $10^{-3}$ mol, per mol of silver halide.

Of the above-mentioned metals, incorporation of lead, iridium or bismuth into the grains is especially preferred.

The position of the above-mentioned metal incorporated into the previously non-fogged internal latent image-type emulsion for use in the present invention is not specifically defined, but it is preferred that the metal is incorporated into the core of a core/shell structure-having internal latent image-type emulsion.

For incorporating the metal into the silver halide grains, a metal ion in the form of an aqueous solution thereof or an organic solvent solution thereof may be added during the step of forming silver halide grains by blending a silver ion solution and an aqueous halogen solution. Alternatively, a metal ion in the form of an aqueous solution thereof or an organic solvent solution thereof may be added to the grains as already formed and thereafter the resulting grains may be coated further with a silver halide.

A method of incorporating the metal into silver halide grains is described in detail, for example, in U.S Pat. Nos. 3,761,276 and 4,395,478 and JP-A-59-216136.

The silver halide grains which can be used in the present invention preferably have a mean grain size of from 0.1 micron to 1.5 microns, especially from 0.2 micron to 1.2 microns. (The grain size indicates the diameter of the grain when the grain is spherical or nearly spherical or indicates the length of the edge of the grain when it is a cubic grain; and the mean grain size indicates a mean value based on the projected area of the grains.) The grain size distribution in the emulsion for use in the present invention may be either narrow or broad, but a so-called "monodispersed" silver halide emulsion which has a narrow grain size distribution such that 90% by weight or by number or more, especially 95% by weight or by number or more, of all of the grains has a grain size falling within the range of the mean grain size plus/minus 40%, more preferably plus/minus 30%, most preferably plus/minus 20%, is preferably employed in the present invention for the purpose of improving the graininess and sharpness of the photographic material. Additionally, in order to satisfy the intended gradation of the photographic material, two or more monodispersed silver halide emulsions each having a different grain size distribution or a plurality of grains each having the same size but having a different sensitivity may be blended into the same layer or may be coated as different layers, in forming an emulsion layer having a substantially the same color sensitivity. Additionally, a combination of two or more polydispersed silver halide emulsions or a combination of a monodispersed emulsion and a polydispersed emulsion may be blended into the same layer or may be coated as different layers.

Regarding the shape of the silver halide grains for use in the present invention, the grains may have a regular crystalline form such as cubic, octahedral, dodecahedral or tetradecahedral crystalline form, or may have an irregular crystalline form such as a spherical crystalline form, or may have a composite form composed of a mixture of such crystalline forms. Additionally, the grains may be tabular grains, and an emulsion containing tabular grains having an aspect ratio (length/thickness) of 5 or more, especially 8 or more, in a proportion of 50% or more of the projected area of the total grains may also be employed in the present invention.

The silver halide composition of the grains used in the present invention can be silver chloride, silver bromide and mixed silver halides. Silver halides which are preferably employed in the present invention are those containing no silver iodide or those containing up to 3 mol % or less silver iodide, for example, silver chloro(iodo)bromide, silver (iodo)-chloride or silver (iodo)bromide.

The silver halide emulsion for use in the present invention may be chemically sensitized in the inside of the grains or on the surface thereof, by sulfur or selenium sensitization, reduction sensitization and/or noble metal sensitization.

Examples of chemical sensitization are described in detail, for example, in the patent publications as mentioned in *Research Disclosure,* No. 17643-III (issued in December, 1978), page 23.

The photographic emulsion for use in the present invention is color-sensitized with photographic sensitizing dyes by a conventional method. Especially useful dyes for color-sensitization are cyanine dyes, merocyanine dyes and complex merocyanine dyes, and these dyes may be used alone or as a combination of two or more of them. The dyes may be combined with super-color sensitizing agents. Examples of color sensitizing dyes and super-color sensitizing agents which may be employed in the present invention are described in detail, for example, in the patent publications as mentioned in *Research Disclosure,* No. 17643-IV (issued in- December, 1978), pages 23 to 24.

The photographic emulsion for use in the present invention can contain an antifoggant or a stabilizer for the purpose of preventing the fogging of the emulsion or of stabilizing the photographic property of the emulsion, during manufacture, storage or photographic processing of the photographic material. Examples of antifoggant and stabilizer compounds usable for these purpose are described in detail, for example, in *Research Disclosure,* No. 17643-VI (issued in December, 1978) and B. J. Birr, *Stabilization of Photographic Silver halide Emulsion* (published by Focal Press in 1974).

In forming direct positive color images in accordance with the present invention, other color couplers may be used in addition to the above-described couplers. Color couplers are compounds which react with the oxidation product of an aromatic primary amine-type color developing agent by a coupling reaction to form or release a substantially non-diffusible dye. Preferably, they are substantially non-diffusible compounds by themselves. Specific examples of useful color couplers are naphthol or phenol compounds, pyrazolone or pyrazoloazole compounds, and open-chain or heterocyclic ketomethylene compounds. Examples of these cyan couplers which may be employed in the present invention are described in *Research Disclosure,* No. 17643 (issued in December, 1978), page 25, Item VII-D; ibid., No. 18717 (issued in November, 1979); and JP-A-62-215272; as well as in patent publications as referred to therein.

Additionally, colored couplers which have the function of correcting unnecessary absorption in the short wavelength range of dyes formed in the photographic material, couplers capable of forming coloring dyes having an appropriate diffusibility, colorless couplers, DIR couplers capable of releasing a development inhibitor on coupling, and polymerized couplers may also be used in the present invention.

Where the nucleating agent-containing hydrophilic colloid layer is a silver halide emulsion layer in the present invention, it is preferred, as mentioned above, that the coupler is emulsified and dispersed separately from the silver halide emulsion to which a nucleating agent is to be added and thereafter the resulting coupler-containing dispersion is added to the nucleating agent-containing silver halide emulsion. The coupler-containing organic solvent solution may optionally contain a color image stabilizer, a hydroquinone derivative and an ultraviolet absorbent, if desired. Examples of high boiling point organic solvents for dissolving couplers, which can be used, are described in U.S. Pat. No. 2,322,027. For instance, phthalates (e.g., dibutyl phthalate, dicyclohexyl phthalate), phosphates or phosphonates (e.g., triphenyl phosphate, tricresyl phosphate), benzoates (e.g., 2-ethylhexyl benzoate, dodecyl benzoate), amides (e.g., N,N-diethyldodecanamide), and alcohols or phenols (e.g., isostearyl alcohol) can be used. Suitable low boiling point solvents which are also usable in the present invention are, for example, ethyl acetate, methyl ethyl ketone and cyclohexanone. The dissolved coupler solution is blended with an aqueous solution containing a hydrophilic binder such as gelatin, in the presence of an anionic surfactant such as alkylbenzenesulfonic acids or alkylnaphthalenesulfonic acids and/or nonionic surfactants such as sorbitan sesquioleates or sorbitan monolaurates, and the resulting blend is then emulsified and dispersed with a high performance rotary mixer, a colloid mill or an ultrasonic dispersing device.

The process of latex dispersion as also described in U.S. Pat. No. 4,199,363 and West German Patent (OLS) Nos. 2,541,274 and 2,541,230 can also be used. Gelatin is advantageously used, but -any other hydrophilic colloid may also be used, as a binder or a protective colloid which may be used in the lodable latex polymer described in U.S. Pat. No. 4,203,716 or in the emulsion layer or interlayer of the photographic material of the present invention.

The photographic material of the present invention can contain a color-fogging inhibitor or a color-mixing inhibitor.

Specific examples of these inhibitors are described in JP-A-62-215272, pages 600 to 663.

A coloring enhancer may be used in the present invention for the purpose of improving the coloring capacity of the couplers in the photographic material. Specific examples of enhancer compounds are described in JP-A-62-215272, pages 374 to 391.

The photographic material of the present invention may contain an anti-irradiation dye, an anti-halation dye, an ultraviolet absorbent, a plasticizer, a brightening agent, a mat agent, an aerial fogging inhibitor, a coating aid, a hardening agent, an anti-static agent and a slide property-improving agent. Specific examples of these additives are described in *Research Disclosure,* No. 17643, VIII to XIII (issued in December, 1978), pages 25 to 27, and ibid., No. 18716 (issued in November, 1979), pages 647 to 651.

The present invention is applicable to a multi-layer multi-color photographic material having at least two layers each having a different color sensitivity on a support. For instance, there is mentioned a multi-layer natural color photographic material, which generally has at least one red-sensitive silver halide emulsion layer, at least one green-sensitive silver halide emulsion layer and at least one blue-sensitive silver emulsion layer on a support. The order of forming the layers on a support may be varied. Preferred examples of the order of the layers comprising red-sensitive, green-sensitive and blue-sensitive layers are on a support in this order, or green-sensitive, red-sensitive and blue-sensitive layers on a support in this order. The respective layers mentioned above may be composed of two or more sub-emulsion layers each having a different degree of sensitivity; or a non light-sensitive layer may be present between two or more emulsion layers each having the same color-sensitivity. In general, a cyan-forming coupler is incorporated into a red-sensitive emulsion layer, a magenta-forming coupler into a green-sensitive emulsion layer, and a yellow-forming coupler into a blue-sensitive emulsion layer. However, different combinations may also be employed, as desired.

The photographic material of the present invention preferably has other various auxiliary layers, such as a protective layer, an interlayer, a filter layer, an anti-halation layer, a backing layer and a white reflecting layer, in addition to the above-described silver halide emulsion layers.

In preparing the photographic material of the present invention, the photographic emulsion layers and other layers are coated on a support, for example, as described in *Research Disclosure,* No. 17643, VII (issued in December, 1978), page 28 or in European Patent 0,102,253 and JP-A-61-97555. The coating method described in *Research Disclosure,* No. 17643, XV, pages 28 and 29 can be utilized.

The color developer which is used for development of the photographic material of the present invention is preferably an alkaline aqueous solution containing an aromatic primary amine-type color developing agent. Color developing agents which can be used are p-phenylenediamine compounds and they are preferably used, although aminophenol compounds are also useful. Sulfates, hydrochlorides and p-toluenesulfonates of the compounds may also be used. The compounds can be used alone or as a combination of two or more of them.

The color developer for use in the present invention has a pH value of from 9 to 12, preferably from 9.5 to 11.5.

After color-development, the photographic emulsion layer is generally desilvered. For desilvering, bleaching and fixation may be effected simultaneously (bleach-fixation) or separately from each other. In order to accelerate the processing, bleaching may be followed by bleach-fixation. Additionally, a bleach-fixation bath composed of two processing tanks in series may be used; or fixation may be effected prior to bleach-fixation; bleach-fixation may be followed by bleaching. These embodiments may freely be selected as desired.

The photographic material of the present invention is generally rinsed in water and/or stabilized, after desilvering. The amount of the rinsing water to be used in the rinsing step may vary over a broad range, in accordance with the characteristics of the photographic material (for example, materials present, such as couplers in the photographic material) to be processed, the use thereof, as well as the temperature of the rinsing water, the number of the rinsing tanks (rinsing stages), the replenishment system of a countercurrent stream or a normal stream, and other various conditions. The relationship between the number of the rinsing tanks and the amount of the rinsing water to be used in a multi-stage countercurrent system may be obtained using the method described in *Journal of the Society of Motion Picture and Television Engineers,* Vol. 64, pages 248 to 253 (May, 1955).

The photographic material of the present invention may contain a color-developing agent for the purpose of simplifying and promoting the processing of the material. In this case, various color-developing agent precursors are preferably used, for incorporating the agent into the photographic material.

Compounds of the following general formula (A) are preferred as the developing agent in the color developer to be used in the present invention.

Specifically, where the compounds of formula (A) described below are used as the developing agent, the coloring dye to be formed from the yellow coupler in the blue-sensitive emulsion layer is quite similar to a printing yellow ink and the color hue of a magenta ink.

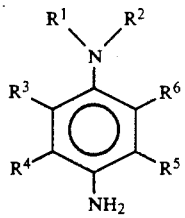

(A)

In the formula, $R_1$ and $R_2$ each represent a hydrogen atom or an alkyl group (having from 1 to 8 carbon atoms, such as methyl, ethyl, propyl, benzyl, allyl, cyclopentyl). The alkyl group may optionally be substituted by a halogen atom, a hydroxyl group, an amino group, a sulfo group, a carboxy group, an alkoxy group, an acylamino group, a cyano group, an acyl group, a sulfonyl group, a carbamoyl group, a sulfamoyl group, an alkoxycarbonylamino group, a carbamoylamino group and/or a heterocyclic group. These substituents which may be on the alkyl group may further be substituted. $R_3$, $R_4$, $R_5$ and $R_6$ each represent a hydrogen atom, a halogen atom (e.g., chlorine), a hydroxyl group, an amino group (having up to 8 carbon atoms, such as N,N-dimethylamino), an alkoxy group (having from 1 to 8 carbon atoms, such as methoxy, ethoxy), an acylamino group (having from 2 to 8 carbon atoms, such as acetylamino, benzoylamino), a sulfonamido group (having from 1 to 8 carbon atoms, such as methanesulfonamido, benzenesulfonamido), an alkoxycarbonylamino group (having from 2 to 8 carbon atoms, such as methoxycarbonylamino, butoxycarbonylamino), a carbamoylamino group (having from 1 to 8 carbon atoms, such as N,N-dimethylcarbamoylamino), or an alkyl group (having from 1 to 8 carbon atoms, such as methyl, ethyl, pentyl). These may optionally be substituted, with substituents described $R^1$. $R^1$ and $R^2$ may together form a hetero ring; and $R^3$ and $R^6$ may together form a condensed ring. Where $R^1$ and $R^2$ are both alkyl groups, they must not be substituted by a sulfonamido group.

Preferably, $R^1$ and $R^2$ each are an alkyl group; and more preferably, at least one of $R^1$ and $R^2$ is a substituted alkyl group.

In formula (A), $R^3$, $R^4$, $R^5$ and $R^6$ each are preferably a hydrogen atom, an acylamino group, an alkoxycarbonylamino group or an alkyl group. Most preferably, they each are a hydrogen atom or an alkyl group.

Where the compounds of the formula (A) are in the form of free amines, they are extremely unstable. Therefore, in general, they are preferably prepared and stored in the form of salts thereof with inorganic acids or organic acids, and the salts are converted into the corresponding free amines only when they are actually added to the processing solution for use. Examples of organic and inorganic acids forming salts of compounds of the formula (A) are hydrochloric acid, sulfuric acid, phosphoric acid, p-toluene sulfonic acid, methanesulfonic acid and naphthalene-1,5-disulfonic acid.
Specific examples of color developing agents which are preferably used in the present invention are described below. However, these examples are not to be construed as limitative.
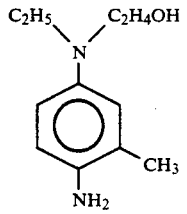
(1)
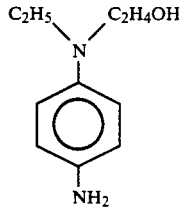
(2)
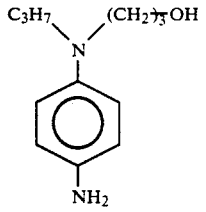
(3)
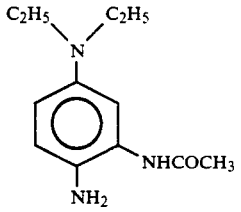
(4)
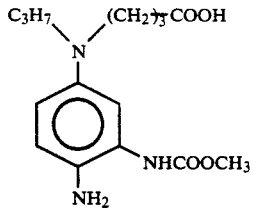
(5)
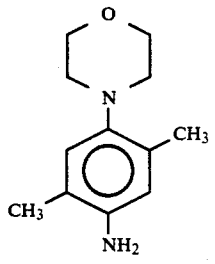
(6)
-continued
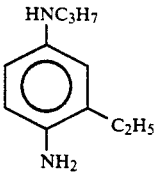
(7)
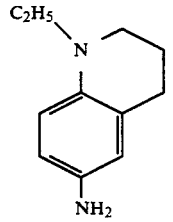
(8)
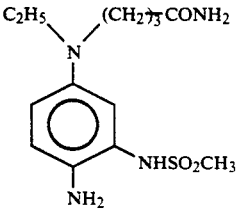
(9)
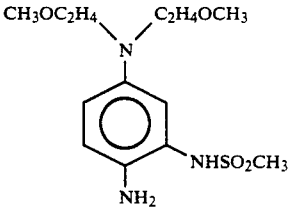
(10)
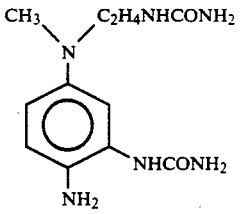
(11)
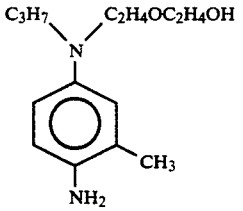
(12)
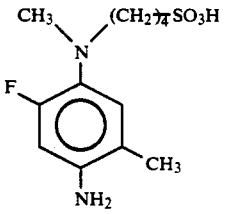
(13)

-continued (14)

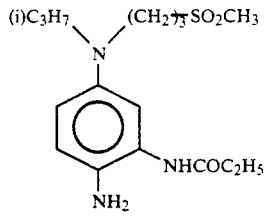

(15)

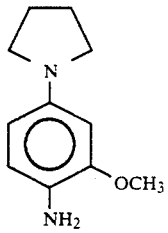

(16)

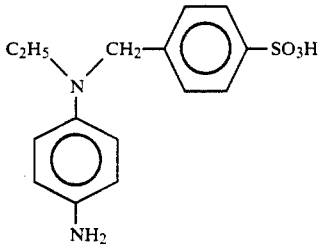

The present invention is explained in greater detail by way of the following examples, which, however, are not intended to restrict the scope of the present invention. Unless otherwise indicated hereto, all parts, percents, ratios and the like are by weight.

EXAMPLE 1

The following first to fourteenth layers were coated on one surface of a paper support (having a thickness of 100 microns) both surfaces of which had been laminated with polyethylene, while the following fifteenth and sixteenth layers were coated on the back surface thereof, to prepare a color photographic material sample. The polyethylene on the emulsion layer side contained titanium oxide (4 g/m$^2$) as a white pigment and a slight amount (0.003 g/m$^2$) of ultramarine as a blueish dye. The chromaticity of the surface of the support was 88.0, −0.20 and −0.75, measured using the (L*, a*, b*) system.

Composition of Photographic Layers

The components and amounts thereof coated (in g/m$^2$) are described below. The amount of silver halide coated is represented by the amount of silver therein. The emulsions in the respective layers were prepared using the method of preparing Emulsion (EM-1) mentioned below. The emulsion in the fourteenth layer was a Lippmann emulsion which had not been subjected to surface-chemical sensitization.

| | |
|---|---|
| First Layer: Anti-Halation Layer | |
| Black Colloidal Silver | 0.10 |
| Gelatin | 0.70 |
| Second Layer: Interlayer | |
| Gelatin | 0.70 |
| Third Layer: Low-Sensitivity Red-Sensitive Layer | |
| Silver Bromide Emulsion color-sensitized with Red-Sensitizing Dye (ExS-1, 2, 3) (mean grain size 0.25 micron; size distribution (fluctuation coefficient) 8%; octahedral grains) | 0.04 |
| Silver Chlorobromide Emulsion color-sensitized with Red-Sensitizing Dye (ExS-1, 2, 3) (silver chloride content 5 mol %: mean grain size 0.40 micron; size distribution 10%; octahedral grains) | 0.08 |
| Gelatin | 1.00 |
| Cyan Coupler (ExC-1, 2, 3 of 1/1/0.2) | 0.30 |
| Anti-Fading Agent (Cpd-1, 2, 3, 4 of 1/1/1/1) | 0.18 |
| Stain Inhibitor (Cpd-5) | 0.003 |
| Coupler Dispersing Agent (Cpd-8) | 0.03 |
| Coupler Solvent (Solv-1, 2, 3 of 1/1/1) | 0.12 |
| Fourth Layer: High-Sensitivity Red-Sensitive Emulsion | |
| Silver Bromide Emulsion color-sensitized with Red-Sensitizing Dye (ExS-1, 2, 3) (mean grain size 0.60 micron; size distribution 15%, octahedral grains) | 0.14 |
| Gelatin | 1.00 |
| Cyan Coupler (ExC-1, 2, 3 of 1/1/0.2) | 0.30 |
| Anti-Fading Agent (Cpd-1, 2, 3, 4 of 1/1/1/1) | 0.18 |
| Coupler Dispersing Agent (Cpd-6) | 0.03 |
| Coupler Solvent (Solv-1, 2, 3 of 1/1/1) | 0.12 |
| Fifth Layer: Interlayer | |
| Gelatin | 1.00 |
| Color Mixing Inhibitor (Cpd-7) | 0.08 |
| Color Mixing Inhibitor Solvent (Solv-4, 5 of 1/1) | 0.16 |
| Polymer Latex (Cpd-8) | 0.10 |
| Sixth Layer: Low Sensitive Green-Sensitive Layer | |
| Silver Bromide Emulsion color-sensitized with Green-Sensitizing Dye (ExS-4) (mean grain size 0.25 micron, size distribution 8%, octahedral grains) | 0.04 |
| Silver Chlorobromide Emulsion color-sensitized with Green-Sensitizing Dye (ExS-4) (silver chloride content 5 mol %; mean grain size 0.4 micron; size distribution 10%; octahedral grains) | 0.06 |
| Gelatin | 0.80 |
| Magenta Coupler (ExM-1) | 0.11 |
| Anti-Fading Agent (Cpd-9, 26 of 1/1) | 0.15 |
| Stain Inhibitor (Cpd-10, 11, 12, 13 of 10/7/7/1) | 0.025 |
| Coupler Dispersing Agent (Cpd-6) | 0.05 |
| Coupler Solvent (Solv-4, 6 of 1/1) | 0.15 |
| Seventh Layer: High Sensitivity Green-Sensitive Layer | |
| Silver Bromide Emulsion color-sensitized with Green-Sensitizing Dye (ExS-4) (mean grain size 0.65 micron; size distribution 16%, octahedral grains) | 0.10 |
| Gelatin | 0.80 |
| Magenta Coupler (ExM-1) | 0.11 |
| Anti-Fading Agent (Cpd-9, 26 of 1/1) | 0.15 |
| Stain Inhibitor (Cpd-10, 11, 12, 13 of 10/7/7/1) | 0.025 |
| Coupler Dispersing Agent (Cpd-6) | 0.05 |
| Coupler Solvent (Solv-4, 6 of 1/1) | 0.15 |
| Eighth Layer: Interlayer | |
| Same as fifth layer | |
| Ninth Layer: Yellow Filter Layer | |
| Yellow Colloidal Silver (grain size 100 Å) | 0.12 |

-continued

| | |
|---|---|
| Gelatin | 0.70 |
| Color Mixing Inhibitor (Cpd-7) | 0.03 |
| Color Mixing Inhibitor Solvent (Solv-4, 5 of 1/1) | 0.10 |
| Polymer Latex (Cpd-8) | 0.07 |
| Tenth Layer: Interlayer | |
| Same as fifth layer | |
| Eleventh Layer: Low-Sensitivity Blue-Sensitive Layer | |
| Silver Bromide Emulsion color-sensitized with Blue-Sensitizing Dye (ExS-5, 6) (mean grain size 0.40 micron, size distribution 8%; octahedral grains) | 0.07 |
| Silver Chlorobromide Emulsion color-sensitized with Blue-Sensitizing Dye (ExS-5, 6) (silver chloride content 8 mol %; mean grain size 0.60 micron; size distribution 11%; octahedral grains) | 0.14 |
| Gelatin | 0.80 |
| Yellow coupler (ExY-1, 2 of 1/1) | 0.35 |
| Anti-Fading Agent (Cpd-14) | 0.10 |
| Stain Inhibitor (Cpd-5, 15 of 1/5) | 0.007 |
| Coupler Dispersing Agent (Cpd-6) | 0.05 |
| Coupler Solvent (Solv-2) | 0.10 |
| Twelfth Layer: High Sensitivity Blue-Sensitive Layer | |
| Silver Bromide Emulsion color-sensitized with Blue-Sensitizing Dye (ExS-5, 6) (mean grain size 0.85 micron; size distribution 18%; octahedral grains) | 0.15 |
| Gelatin | 0.60 |
| Yellow Coupler (ExY-1, 2 of 1/1) | 0.10 |
| Anti-Fading Agent (Cpd-14) | 0.10 |
| Stain Inhibitor (Cpd-5, 15 of 1/5) | 0.007 |
| Coupler Dispersing Agent (Cpd-6) | 0.05 |
| Coupler Solvent (Solv-2) | 0.10 |
| Thirteenth Layer: Ultraviolet Absorbing Layer | |
| Gelatin | 1.00 |
| Ultraviolet Absorbent (Cpd-2, 4, 16 of 1/1/1) | 0.50 |
| Color Mixing Inhibitor (Cpd-7, 17 of 1/1) | 0.03 |
| Dispersing Agent (Cpd-6) | 0.02 |
| Ultraviolet Absorbent Solvent (Solv-2, 7 of 1/1) | 0.08 |
| Anti-Irradiation Dye (Cpd-18, 19, 20, 21, 27 of 10/10/13/15/20) | 0.05 |
| Fourteenth Layer: Protective Layer | |
| Fine Silver Chlorobromide Grains (silver chloride content 97 mol %; mean grain size 0.1 micron) | 0.03 |
| Acryl-Modified Copolymer of Polyvinyl Alcohol (molecular weight 50,000) | 0.01 |
| Mixture (1/1) of Polymethyl Methacrylate Grains (mean grain size 2.4 microns) and Silicon Oxide (mean grain size 5 microns) | 0.05 |
| Gelatin | 1.80 |
| Gelatin Hardening Agent (H-1, H-2 of 1/1) | 0.18 |
| Fifteenth Layer: Backing Layer | |
| Gelatin | 2.50 |
| Ultraviolet Absorbent (Cpd-2, 4, 16 of 1/1/1) | 0.50 |
| Dye (Cpd-18, 19, 20, 21, 27 of 1/1/1/1/1) | 0.06 |
| Sixteenth Layer: Backing-Protecting Layer | |
| Mixture (1/1) of Polymethyl Methacrylate Grains (mean grain size 2.4 microns) and Silicon Oxide (mean grain size 5 microns) | 0.05 |
| Gelatin | 2.00 |
| Gelatin Hardening Agent (H-1, H-2 of 1/1) | 0.14 |

Preparation of Emulsion (EM-1)

An aqueous potassium bromide solution and an aqueous silver nitrate solution were simultaneously added to an aqueous gelatin solution with vigorous stirring at 75° C. over a period of 15 minutes, to obtain octahedral silver bromide grains having a mean grain size of 0.35 micron, whereupon 0.3 g/mol-Ag of 3,4-dimethyl-1,3-thiazoline-2-thione was added to the reaction system. The emulsion was then chemically sensitized by adding 6 mg/mol-Ag of sodium thiosulfate and 7 mg/mol-Ag of chloroauric acid (tetrahydrate) thereto in order followed by heating the resulting emulsion at 75° C. for 80 minutes. The cores of the grains thus obtained were further grown under the same precipitation conditions as the first step to ultimately obtain a monodispersed octahedral core/shell silver bromide emulsion having a mean grain size of 0.7 micron. The coefficient of variation of the grain size of the emulsion was about 10%. The emulsion was then further chemically sensitized by adding 1.5 mg/mol-Ag of sodium thiosulfate and 1.5 mg/mol-Ag of chloroauric acid (tetrahydrate) thereto and heating the resulting emulsion at 60° C. for 60 minutes, to obtain an internal latent image-type silver halide emulsion.

The respective light-sensitive layers contained ExZK-1 and ExZK-2 as a nucleating agent in an amount of $10^{-3}$% by weight and $10^{-2}$% by weight, respectively, to the silver halide. Additionally, the respective layers contained Alkanol XC (product of DuPont) and sodium alkylbenzenesulfonate as an emulsification and dispersion aid, and succinate and Magefac F-120 (product of Dainippon Ink) as a coating aid. The silver halide-containing layers and the colloidal silver-containing layers contained a stabilizer of (Cpd-22, 23, 24, 25). The sample thus prepared was called Sample No. 101.

The compounds used for preparing this sample are described below.

ExS-1
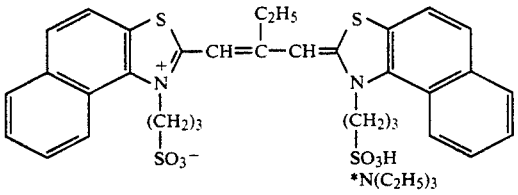
ExS-2
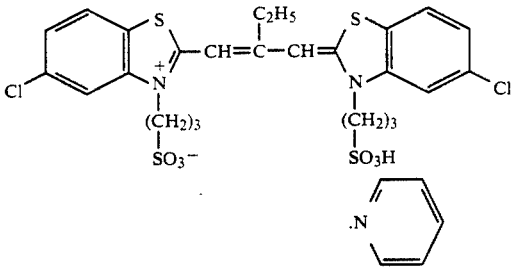
ExS-3
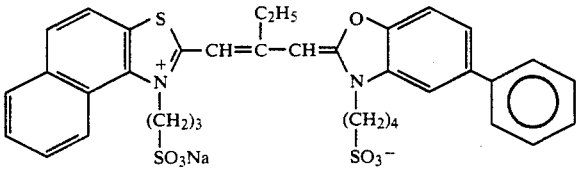
ExS-4
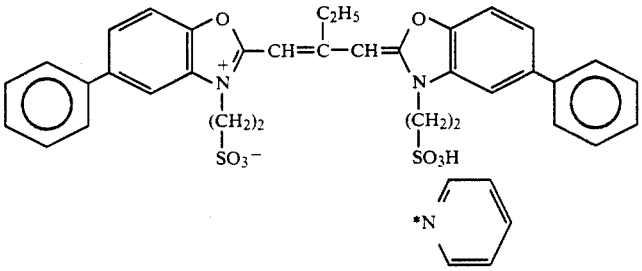
ExS-5
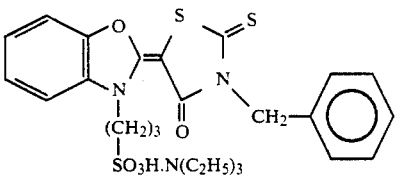
ExS-6
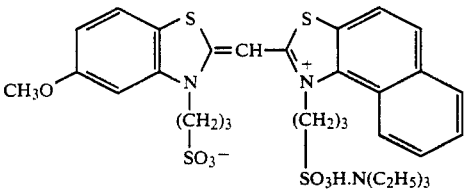
Cpd-1
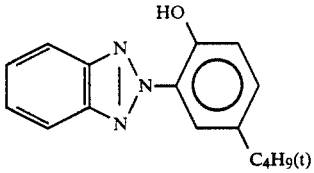
Cpd-2
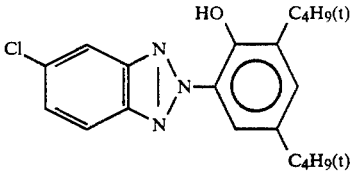
Cpd-3
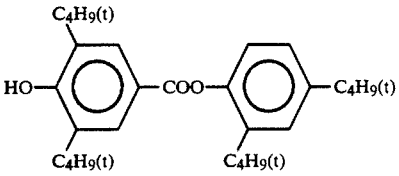
Cpd-4
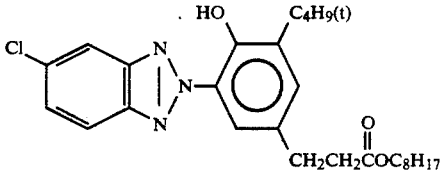
Cpd-5
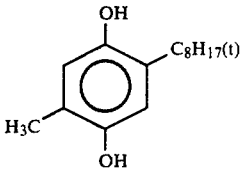
Cpd-6
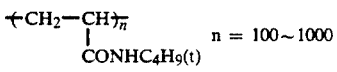

-continued
Cpd-7
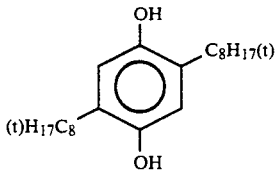
Cpd-8
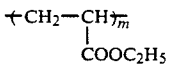
Cpd-9
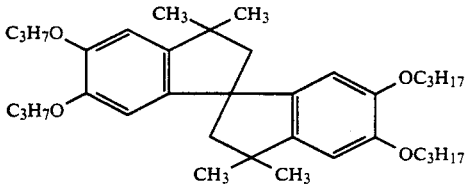
Cpd-10
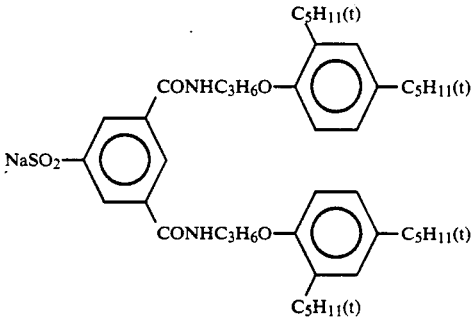
Cpd-11
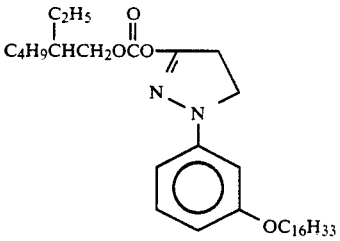
Cpd-12
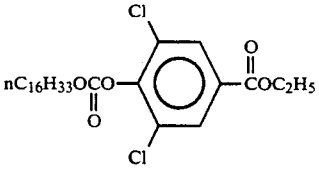
Cpd-13
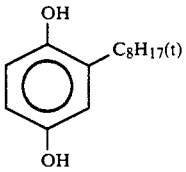
Cpd-14
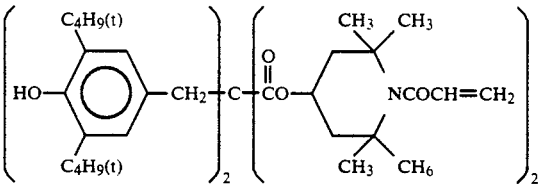
Cpd-15
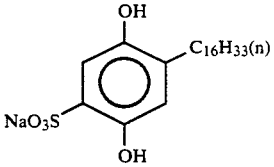
Cpd-16
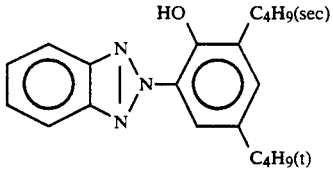
Cpd-17
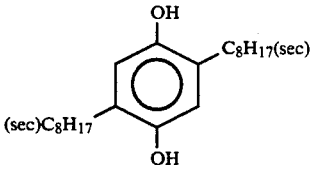
Cpd-18
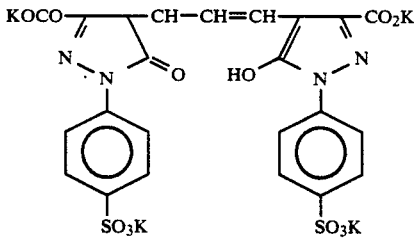
Cpd-19
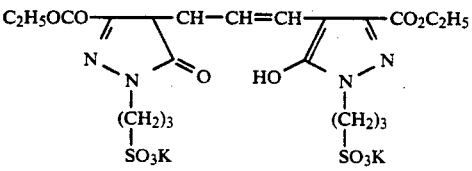

-continued
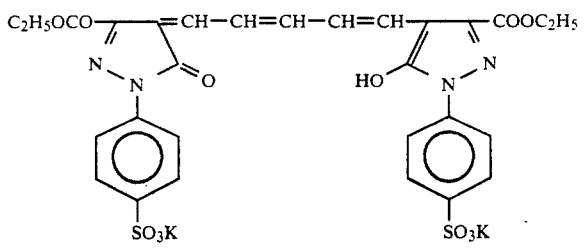
Cpd-20
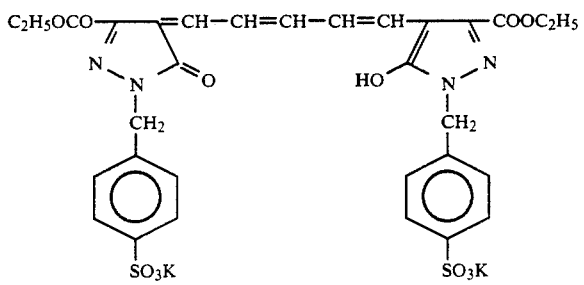
Cpd-21
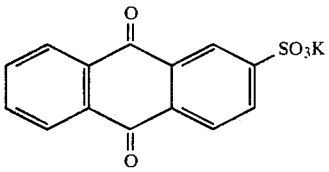
Cpd-22
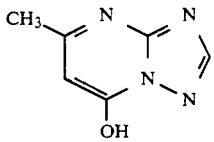
Cpd-23
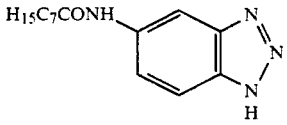
Cpd-24
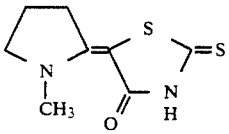
Cpd-25
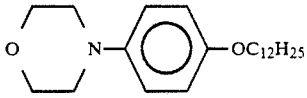
Cpd-26
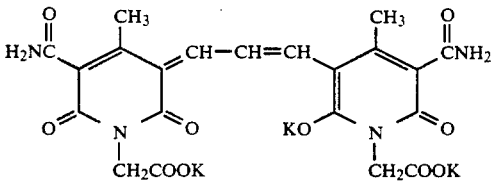
Cpd-27
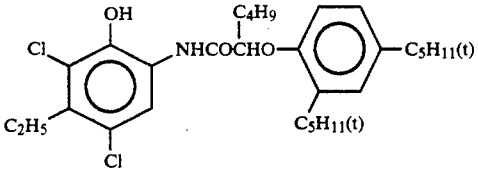
ExC-1
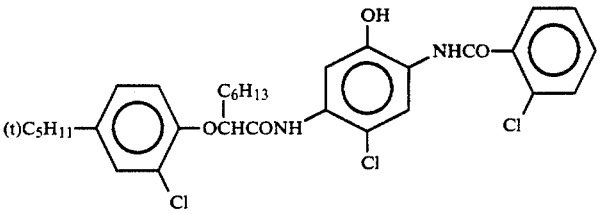
ExC-2

-continued

ExC-3

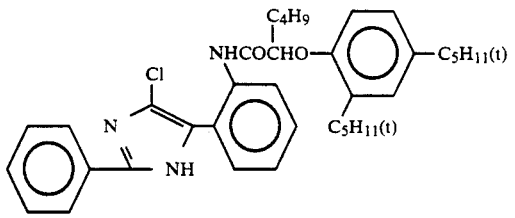

ExM-1

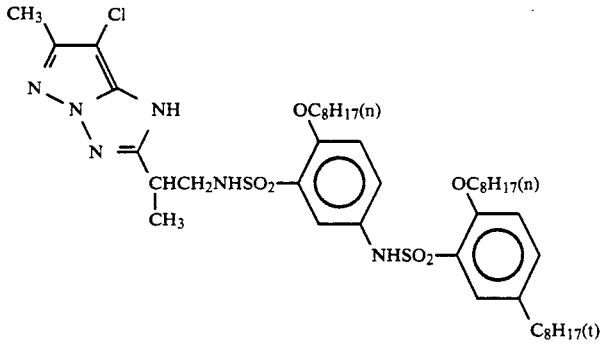

ExY-1

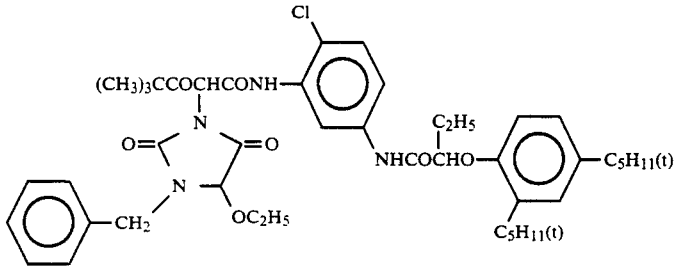

ExY-2

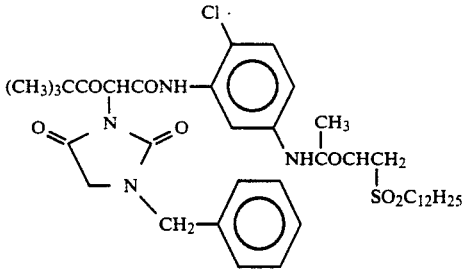

Solv-1: Di(2-ethylhexyl)Sebacate
Solv-2: Trinonyl Phosphate
Solv-3: Di(3-methylhexyl) Phthalate
Solv-4: Tricresyl Phosphate
Solv-5: Dibutyl Phthalate
Solv-6: Trioctyl Phosphate
Solv-7: Di(2-ethylhexyl) Phthalate
H-1: 1,2-bis(Vinylsulfonylacetamido)ethane
H-2: 4,6-Dichloro-2-hydroxy-1,3,5-triazine Sodium Salt
ExZK-1: 7-(3-Ethoxythiocarbonylaminobenzamido)-10-propargyl-1,2,3,4-tetrahydroacridinium Trifluoromethanesulfonate
ExZK-2: 2-[4-{3-[3-{3[5-{3-[2-chloro-5-(1-dodecyloxycarbonylethoxycarbonyl)phenylcarbamoyl]-4-hydroxy-1-naphthylthio}tetrazol-1-yl]phenyl}ureido]benzenesulfonamido}phenyl]-1-formylhydrazine Preparation of Sample Nos. 102 to 107

Sample Nos. 102 to 107 were prepared in the same manner as in the preparation of Sample No. 101, except that the couplers in the sixth layer and the seventh layer were replaced by the compounds as set forth in Table 1 below (ratio of magenta coupler to yellow coupler = 8/2 by mole).

Preparation of Sample Nos. 108 to 117

Sample Nos. 108 to 117 were prepared in the same manner as in the preparation of Sample No. 101, except that the couplers in the sixth layer and the seventh layer were replaced by the compounds as set forth in Table 1 below and that the compound as set forth in Table 1 was added to the sixth layer and the seventh layer.

The thus prepared Sample Nos. 101 to 117 were exposed through a continuous wedge and then developed according to the processing procedure described below. Then each of the cyan, magenta and yellow density of the image formed was measured to obtain $D_{max}$ and $D_{min}$ of each color.

Next, Sample Nos. 101 to 117 were stored under conditions of 30° C. and 60% RH for 2 months and then exposed and developed in the same manner as above.

The density of each color of the image formed was also measured in the same manner as above, to obtain $D_{max}$ and $D_{min}$ of each color.

The results obtained are shown in Table 1.

The relative coupling rate (RM/RY) of the magenta coupler to the yellow coupler in the sixth layer and the seventh layer was obtained according to the method mentioned hereinabove and was as shown in Table 1.

Next, Sample Nos. 101 to 117 were exposed through a Mackbeth Color Chart original using a reflection system and then developed according to the processing method described below. The exposure was effected by varying the amount of light for exposure, and three different kinds of exposed samples were prepared for each sample. The color-reproducibility of the low density, middle density and high density of all samples was checked, in comparison with the original used.

The result obtained are shown in Table 1.

The compounds used above are described below.

ExY-3:

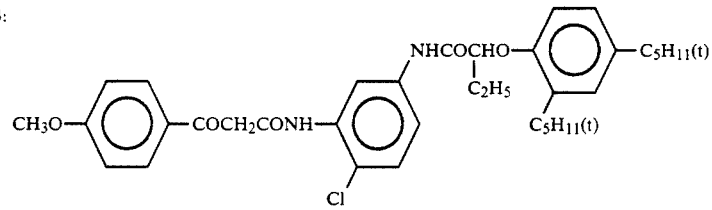

ExM-2:

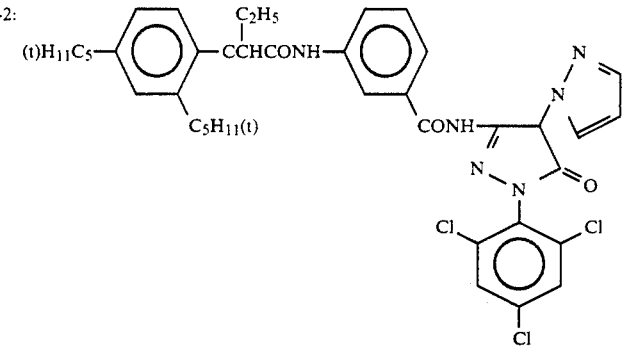

| Processing Steps | Time | Temperature | Capacity of Mother Solution Tank | Amount of Replenisher |
|---|---|---|---|---|
| Color Development | 135 sec | 38° C. | 11 liters | 300 ml/m$^2$ |
| Bleach-Fixation | 40 sec | 33° C. | 3 liters | 300 ml/m$^2$ |
| Rinsing (1) | 40 sec | 33° C. | 3 liters | — |
| Rinsing (2) | 40 sec | 33° C. | 3 liters | 320 ml/m$^2$ |
| Drying | 30 sec | 80° C. | | |

The replenishment system in the rinsing step was the so-called counter current replenishment system where the replenisher is added to the rinsing bath (2) and the overflow from the bath (2) is introduced into the rinsing bath (1). The amount of carryover of the bleach-fixing solution from the rinsing bath (1) to the bleach-fixation bath along with the photographic material being processed was 35 ml/m$^2$, and the amount of the replenisher to the rinsing bath (2) to the carryover of the bleach-fixing solution was 9.1/1.

The processing solutions had the following compositions.

| | Mother Solution | Replenisher |
|---|---|---|
| Color Developer: | | |
| D-Sorbitol | 0.15 g | 0.20 g |
| Sodium Naphthalenesulfonate/ Formaedehyde Condensate | 0.15 g | 0.20 g |
| Ethylenediamine-tetrakismethylene-phosphonic Acid | 1.5 g | 1.5 g |
| Diethylene Glycol | 12.0 ml | 16.0 ml |
| Benzyl Alcohol | 13.5 ml | 18.0 ml |
| Potassium Bromide | 0.70 g | — |
| Benzotriazole | 0.003 g | 0.004 g |
| Sodium Sulfite | 2.4 g | 3.2 g |
| N,N-bis(Carboxymethyl)hydrazine | 4.0 g | 5.3 g |
| D-Glucose | 2.0 g | 2.4 g |
| Triethanolamine | 6.0 g | 8.0 g |
| N-Ethyl-N-(β-methanesulfonamidoethyl)-3-methyl-4-aminoaniline Sulfate | 6.4 g | 8.5 g |
| Potassium Carbonate | 30.0 g | 25.0 g |
| Brightening Agent (diaminostilbene compound) | 1.0 g | 1.2 g |
| Water to make | 1000 ml | 1000 ml |
| pH (25° C.) | 10.25 | 11.00 |
| Bleach-Fixing Solution: | | |
| Disodium Ethylenediamine-tetraacetate Dihydrate | 2.0 g | (same as mother solution) |
| Ammonium Ethylenediamine-tetraacetate/Fe(III) Complex Dihydrate | 70.0 g | |
| Ammonium Thiosulfate (700 g/liter) | 180 ml | |
| Sodium p-Toluenesulfinate | 45.0 g | |
| Sodium Bisulfite | 35.0 g | |
| 5-Mercapto-1,3,4-triazole | 0.5 g | |
| Ammonium Nitrate | 10.0 g | |
| Water to make | 1000 ml | |

-continued

| | Mother Solution | Replenisher |
|---|---|---|
| pH (25° C.) | 6.10 | |

Rinsing Water: Mother solution and replenisher were same.

City water was passed through a mixed-bed column filled with an H-type strong acidic cation exchange resin (Amberlite IR-120B, manufactured b Rhom & Haas) and an OH-type anion exchange resin (Amberlite IR-400, manufactured by Rhom & Haas) whereby the both the calcium ion concentration and the magnesium ion concentration were both lowered to 3 mg/liter or less, and subsequently, 20 mg/liter of sodium dichloroisocyanurate and 0.15 g/liter of sodium nitrate were added to the thus treated water. The resulting water had a pH value within the range of from 6.5 to 7.5.

TABLE 1

| Sample No. | Compound Added to 6th and 7th Layers | Couplers in 6th and 7th Layers | | | Fresh Sample | | Aged Sample (Stored at 30° C. and 60% RH for 2 months) | | Color-Reproducibility of Magenta | | |
|---|---|---|---|---|---|---|---|---|---|---|---|
| | | Magenta | Yellow | RM/RY | Magenta $D_{max}$ | Magenta $D_{min}$ | Magenta $D_{max}$ | Magenta $D_{min}$ | Low Density | Middle Density | High Density |
| 101 (Comparison) | — | ExM-1 | — | — | 2.05 | 0.19 | 2.01 | 0.19 | X (YL) | X (YL) | X (YL) |
| 102 (Comparison) | — | " | ExY-3 | 1.5 | 1.53 | 0.19 | 1.42 | 0.21 | ○ | ○ | ○ |
| 103 (Comparison) | — | ExM-2 | ExY-1 | 1.8 | 1.92 | 0.19 | 1.87 | 0.20 | X (C) | X (C) | X (C) |
| 104 (Comparison) | — | M-10 | Y-1 | 0.3 | 1.75 | 0.19 | 1.60 | 0.21 | X (ML) | ○ | ○ |
| 105 (Comparison) | — | M-21 | Y-24 | 2.4 | 1.80 | 0.19 | 1.65 | 0.21 | X (YL) | ○ | ○ |
| 106 (Comparison) | — | M-12 | Y-27 | 0.7 | 1.83 | 0.19 | 1.69 | 0.21 | ○ | ○ | ○ |
| 107 (Comparison) | — | M-14 | Y-19 | 1.8 | 1.88 | 0.19 | 1.73 | 0.21 | ○ | ○ | ○ |
| 108 (Comparison) | A-2 | ExM-1 | — | — | 2.09 | 0.19 | 2.06 | 0.19 | X (YL) | X (YL) | X (YL) |
| 109 (Comparison) | " | " | ExY-3 | 1.5 | 1.55 | 0.19 | 1.45 | 0.20 | ○ | ○ | ○ |
| 110 (Comparison) | " | ExM-2 | ExY-1 | 1.8 | 1.96 | 0.19 | 1.93 | 0.20 | X (C) | X (C) | X (C) |
| 111 (Comparison) | " | M-10 | Y-1 | 0.3 | 1.93 | 0.19 | 1.90 | 0.19 | X (ML) | ○ | ○ |
| 112 (Comparison) | " | M-21 | Y-24 | 2.4 | 2.02 | 0.19 | 1.98 | 0.19 | X (YL) | ○ | ○ |
| 113 (The Invention) | A-2 | M-12 | Y-27 | 0.7 | 1.98 | 0.19 | 1.96 | 0.19 | ○ | ○ | ○ |
| 114 (The Invention) | " | M-14 | Y-19 | 1.8 | 1.96 | 0.19 | 1.94 | 0.19 | ○ | ○ | ○ |
| 115 (The Invention) | " | M-11 | Y-3 | 1.2 | 1.94 | 0.19 | 1.93 | 0.19 | ○ | ○ | ○ |
| 116 (The Invention) | A-6 | M-16 | Y-33 | 1.4 | 1.97 | 0.19 | 1.94 | 0.19 | ○ | ○ | ○ |
| 117 (The Invention) | A-15 | M-10 | Y-14 | 0.8 | 1.93 | 0.19 | 1.91 | 0.19 | ○ | ○ | ○ |
| 118 (The Invention) | A-29 | M-18 | Y-6 | 1.7 | 1.99 | 0.19 | 1.97 | 0.19 | ○ | ○ | ○ |
| 119 (The Invention) | A-34 | M-20 | Y-17 | 1.1 | 1.94 | 0.19 | 1.92 | 0.19 | ○ | ○ | ○ |

Notes:
X: No good, ○: Good, (YL): Yellowish color lacking, (ML): Magentaish color lacking, (C): Cyanish color From the results in Table 1 above, the following conclusions can be drawn.

(1) Regarding the couplers in the green-sensitive emulsion layer, where the relative coupling rate (RM/RY) of the pyrazoloazole magenta coupler to the yellow coupler is within the range of the present invention of from 0.5 to 2.0, the color-reproducibility of the magenta coloring density is good throughout the range of from low density to high density. However, where the ratio of RM/RY is outside the range of the present invention, the color-reproducibility is not good.

(2) Regarding the couplers in the green-sensitive emulsion layer, where a pyrazoloazole magenta coupler and a yellow coupler are used in combination, the magenta coloring density is extremely low when the yellow coupler used is a 4-equivalent coupler, as compared with the use of a 2-equivalent yellow coupler.

(3) Regarding the couplers in the green-sensitive emulsion layer, where a pyrazoloazole magenta coupler and a yellow coupler are used in combination and the photographic material is exposed and developed after storage at a high temperature (30° C.) for a long period of time, the value of $D_{max}$ is reduced and the value of $D_{min}$ increases that is, the quality of the image formed is markedly lawered, as compared with the corresponding fresh sample.

However, where a compound of formula (II) or (III) of the present invention is present to the green-sensitive emulsion layer, a reduction in the value of Dmax and an increase in the value of Dmin caused by long-time storage of the photographic material is inhibited.

EXAMPLE 2

Preparation of Sample No. 201

Sample No. 201 was prepared in the same manner as in preparation of Sample No. 101, except that the yellow coupler in the eleventh and twelfth layers was replaced by (Y-101).

Preparation of Sample Nos. 202 to 211

Sample Nos. 202 to 211 were prepared in the same manner as in preparation of Sample No. 201, except that the couplers in the sixth and seventh layers were replaced by the compounds as indicated in Table 2 below and that the compound also set forth in Table 2 was added to the sixth and seventh layers each in an amount of $10^{-2}$% by weight to silver halide.

The thus prepared Sample Nos. 201 to 211 were exposed through a Mackbeth Color Chart original, in the same manner as in Example 1. The exposed samples were then developed in the same manner as in Example 1, except that Developing Agent (2) was used in place of the developing agent (N-ethyl-N-(β-methanesulfonamidoethyl)-3-methyl-4-aminoaniline sulfate) in the color developer. The color-reproducibility of each of the thus processed samples was evaluated in the same manner as in Example 1.

The results obtained are shown in Table 2 below.

TABLE 2

| Sample No. | Compound Added to 6th and 7th Layers | Couplers in 6th and 7th Layers | | | Coupler in 11th and 12th Layers | Fresh Sample | |
|---|---|---|---|---|---|---|---|
| | | Magenta | Yellow | RM/RY | | Magenta $D_{max}$ | Magenta $D_{min}$ |
| 113 (The Invention) | A-2 | M-12 | Y-27 | 0.7 | ExY-1 | 2.07 | 0.18 |
| 201 (Comparison) | — | ExM-1 | — | — | Y-101 | 2.06 | 0.18 |
| 202 (Comparison) | — | " | ExY-3 | 1.5 | " | 1.52 | 0.18 |
| 203 (Comparison) | — | ExM-2 | ExY-1 | 1.8 | " | 1.90 | 0.18 |
| 204 (Comparison) | A-6 | ExM-1 | — | — | " | 2.08 | 0.18 |
| 205 (Comparison) | " | " | ExY-3 | 1.5 | " | 1.58 | 0.18 |
| 206 (Comparison) | " | ExM-2 | ExY-1 | 1.8 | " | 1.95 | 0.18 |
| 207 (The Invention) | A-2 | M-12 | Y-27 | 0.7 | " | 2.08 | 0.18 |
| 208 (The Invention) | A-6 | M-14 | Y-19 | 1.8 | " | 2.03 | 0.18 |
| 219 (The Invention) | " | M-11 | Y-3 | 1.2 | " | 2.01 | 0.18 |
| 210 (The Invention) | " | M-10 | Y-4 | 0.8 | " | 2.04 | 0.18 |
| 211 (The Invention) | " | M-20 | Y-17 | 1.1 | " | 2.01 | 0.18 |

| Sample No. | Aged Sample (Stored at 30° C. and 60% RH for 2 months) | | Color Reproducibility of Yellow | Color-Reproducibility of Magenta | | |
|---|---|---|---|---|---|---|
| | Magenta $D_{max}$ | Magenta $D_{min}$ | | Low Density | Middle Density | High Density |
| 113 (The Invention) | 2.04 | 0.18 | X | ○ | ○ | ○ |
| 201 (Comparison) | 2.04 | 0.19 | ○ | X (YL) | X (YL) | X (YL) |
| 202 (Comparison) | 1.45 | 0.21 | ○ | ○ | ○ | ○ |
| 203 (Comparison) | 1.83 | 0.20 | ○ | X (C) | X (C) | X (C) |
| 204 (Comparison) | 2.06 | 0.18 | ○ | X (YL) | X (YL) | X (YL) |
| 205 (Comparison) | 1.47 | 0.19 | ○ | ○ | ○ | ○ |
| 206 (Comparison) | 1.91 | 0.19 | ○ | X (C) | X (C) | X (C) |
| 207 (The Invention) | 2.04 | 0.18 | ○ | ○ | ○ | ○ |
| 208 (The Invention) | 2.00 | 0.18 | ○ | ○ | ○ | ○ |
| 219 (The Invention) | 1.98 | 0.18 | ○ | ○ | ○ | ○ |
| 210 (The Invention) | 2.02 | 0.18 | ○ | ○ | ○ | ○ |
| 211 (The Invention) | 1.99 | 0.18 | ○ | ○ | ○ | ○ |

From the results in Table 2 above, the following conclusions can be drawn.

(1) Regarding the couplers in the green-sensitive emulsion layer, where the relative coupling rate (RM/RY) of the pyrazoloazole magenta coupler to the yellow coupler is within the range of the present invention of from 0.5 to 2.0, the color-reproducibility of the magenta coloring density is good throughout the range from low density to high density. However, where the ratio of RM/RY is outside the range of the present invention, the color-reproducibility is not good.

(2) Regarding the couplers in the green-sensitive emulsion layer, where a pyrazoloazole magenta coupler and an yellow coupler are used in combination, the magenta coloring density is extremely low when the yellow coupler used is a 4-equivalent coupler, as compared with the case of using a 2-equivalent yellow coupler.

(3) Regarding the couplers in the green-sensitive emulsion layer, where a pyrazoloazole magenta coupler and an yellow coupler are used in combination and the photographic material is exposed and developed after storage at a high temperature (30° C.) for a long period of time, the value of Dmax is reduced and the value of Dmin is increased, that is, the quality of the image formed extremely lowers, as compared with the corresponding fresh sample.

However, where a compound of formula (II) or (III) of the present invention is added to the green-sensitive emulsion layer, a decrease in the value of Dmax and an increase in the value of Dmin caused by long-time storage of the photographic material is inhibited.

(4) Regarding the couplers in the green-sensitive emulsion layer, the combination of the pyrazoloazole magenta coupler and the 2-equivalent yellow coupler gave a somewhat lower magenta coloring density than the single use of the pyrazoloazole magenta coupler only when the developing agent of Example 1 was used. However, when the developing agent, Compound (2), of Example 2 was used, the combination of the pyrazoloazole magenta coupler and the 2-equivalent yellow coupler and the single use of the pyrazoloazole magenta coupler only are substantially the same as each other with respect to the magenta coloring density.

Additionally, the value of Dmin of the magenta coloring density of the samples processed with the developing agent, Compound (2), was notably smaller than that of the samples processed with the developing agent of Example 1. That is, use of the developing agent, Compound (2), for processing the samples of the invention was found to be extremely favorable.

(5) Where the developing agent, Compound (2), is used, the absorption of the coloring dye formed by the yellow coupler is in the short wavelength range and is similar in color hue to a printing yellow ink, in comparison with the case of using the developing agent of Example 1, N-ethyl-N-(8-methanesulfonamidoethyl)-3-methyl-4-aminoaniline sulfate. Accordingly, use of the developing agent, Compound (2), is preferred from the viewpoint of the color-reproducibility of the processed samples.

(6) The yellow coupler, (Y-101), is preferred to yellow coupler, (ExY-1), since the absorption of the coloring dye formed by the former is in a shorter wavelength range than that from the latter and therefore the hue of the coloring dye formed by the former is more similar to the hue of a printing yellow ink than the that formed by the latter. That is, yellow coupler (Y-101) is favorable in view of the color-reproducibility thereof.

EXAMPLE 3

Sample Nos. 301 to 319 were prepared in the same manner as in preparation of Samples Nos. 101 to 119, respectively, in Example 1, except that the nucleating agents, ExZK-1 and ExZK-2, were not used. These samples were treated in the same manner as in Example 1, that is, they were stored, exposed and developed in the same manner as in Example 1, except that they were uniformly exposed (100 CMS, 30 seconds) during color-development.

The same results as those in Example 1 were obtained.

As explained in detail above, the present invention provides a direct positive color photographic material which contains a coupler capable of providing a magenta-coloring dye having coloring characteristics similar to a printing magenta ink throughout the range of from the low density areas to the high density portion without interfering with the other qualities of the image formed on the material.

Even though a magenta-coloring dye having coloring characteristics similar to a printing magenta ink could be obtained by a prior art technique, the color hue of the total image ultimately formed on the photographic material vary in accordance with the density of the magenta-coloring dye or the other qualities of the image as formed on the material would be deteriorated because of the magenta-coloring dye. For these reasons, it was difficult to employ a conventional positive color photographic material in print-related fields using prior art techniques. Surprisingly and unexpectedly, the direct positive color photographic material of the present invention may fully be employed in print-related fields, as opposed to the prior art techniques.

While the invention has been described in detail and with reference to specific embodiments thereof, it will be apparent to one skilled in the art that various changes and modifications can be made therein without departing from the spirit and scope thereof.

What is claimed is:

1. A direct positive color photographic material comprising a support having thereon at least one previously non-fogged internal latent image silver halide emulsion in which at least one green-sensitive internal latent image-type silver halide emulsion layer contains a 2-equivalent yellow-coloring coupler and a magenta-coloring coupler of the following general formula (M-II):

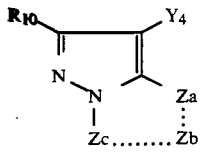

(M-II)

wherein $R_{10}$ represents a hydrogen atom or a substituent;

$Y_4$ represents a hydrogen atom or a removing group;

Za, Zb and Zc each represents a methine group, a substituted methine group, =N— or —NH—;

one of the Za—Zb bond and the Zb—Zc bond is a double bond and the other is a single bond; and when the Zb—Zc bond is a carbon-carbon double bond, it may be part of an aromatic ring; and a dimer or a polymer may be formed at the position of $R_{10}$ or $Y_4$ or at the position of Za, Zb or Zc when Za, Zb or Zc is a substituted methine group, where the relative coupling rate of the 2-equivalent yellow-coloring coupler to the magenta-coloring coupler is within the range of from 0.5 to 2.0, and at least one layer of the photographic material contains at least one compound selected from the group consisting of compounds of the following general formulae (II) and (III):

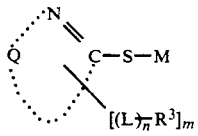

(II)

wherein

Q represents an atomic group necessary for forming a 5-membered or 6-membered heterocyclic ring, which may be condensed with a carbocyclic-aromatic ring or heterocyclic-aromatic ring;

L represents a divalent linking group composed of one or more atoms selected from hydrogen, carbon, nitrogen, oxygen and sulfur atoms;

$R^3$ represents an organic group containing at least one of a thioether group, an amino group, an ammonium group, an ether group and a heterocyclic group;

n represents 0 or 1; m represents 0, 1 or 2; and

M represents a hydrogen atom, an alkali metal atom, an ammonium group, or a group capable of being cleaved under alkaline conditions;

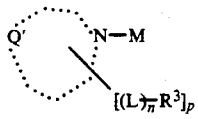

(III)

where

Q' represents an atomic group necessary for forming a 5-membered or 6-membered heterocyclic ring which may form an imino silver;

L, $R^3$, n and M have the same meaning as in the formula (II); and p represents 1 or 2.

2. The direct positive color photographic material as in claim 1, wherein the relative coupling rate of the 2-equivalent yellow-coloring coupler to the magenta-coloring coupler is within the range of from 0.55 to 1.8.

3. The direct positive color photographic material as in claim 1, wherein the 2-equivalent yellow-coloring coupler is a coupler represented by the general formula (Y-I):

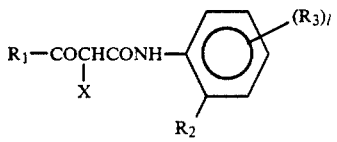

(Y-I)

wherein $R_1$ represents a tertiary alkyl group or an aryl group;

$R_2$ represents a hydrogen atom, a halogen atom, an alkoxy group or an aryloxy group;

$R_3$ represents a halogen atom, an alkyl group, an aryl group, an alkoxy group, an alkoxycarbonyl group, an aryloxycarbonyl group, a carbonamido group, a sulfamoyl group, an alkylsulfonyl group, an arylsulfonyl group, a ureido group or an alkoxycarbonylamino group;

X represents a heterocyclic group which is bonded to the coupling active position of the formula via a nitrogen atom, or an aryloxy group;

l represents an integer of from 0 to 4, provided that when l is a plural number, the $(R_3)$ groups may be same or different; and a dimer or a polymer linked at the position of $R_1$, $R_2$, $R_3$ or X may be formed.

4. The direct positive color photographic material as in claim 1, wherein the color photographic material further contains a blue-sensitive silver halide emulsion layer and the 2-equivalent yellow-coloring coupler in said blue-sensitive silver halide emulsion layer is a coupler represented by the general formula (Y-XI):

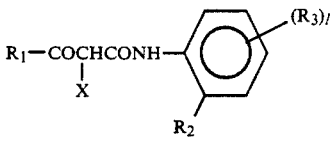

(Y-XI)

wherein $R_1$ represents an aryl group or a tertiary alkyl group;

$R_2$ represents a fluorine atom, an alkyl group, group, an alkoxy group, an aryloxy group, a dialkylamino group, an alkylthio group or an arylthio group;

$R_3$ represents a group which may be a substituent on the benzene ring;

X represents a hydrogen atom or a group capable of being removed by a coupling reaction with the oxidation product of an aromatic primary amine developing agent;

l represents an integer of from 0 to 4, provided that when l is a plural number, the $(R_3)$ groups may be the same or different; and a dimer or a polymer linked at the position of $R_1$, X or

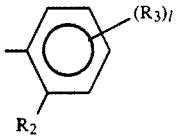

may be formed.

5. The direct positive color photographic material as in claim 4, wherein X in the formula (Y-XI) represents an aryloxy group.

6. The direct positive color photographic material as in claim 4, wherein X in formula (Y-XI) represents a heterocyclic group which is bonded to the coupling active position of the formula via a nitrogen atom and which is represented by a general formula (Y-XII):

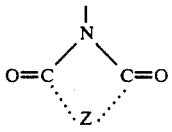

(Y-XII)

wherein

Z represents

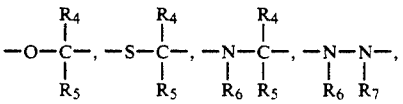

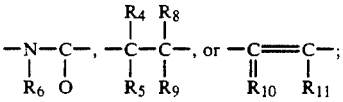

$R_4$, $R_5$, $R_8$ and $R_9$ each represents a hydrogen atom, an alkyl group, an aryl group, an alkoxy group, an aryloxy group, an alkylthio group, an arylthio group, an alkylsulfonyl group, an arylsulfonyl group or an amino group;

$R_6$ and $R_7$ each represents a hydrogen atom, an alkyl group, an aryl group, an alkylsulfonyl group, an arylsulfonyl group or an alkoxycarbonyl group;

$R_{10}$ and $R_{11}$ each represent a hydrogen atom, an alkyl group or an aryl group;

$R_{10}$ and $R_{11}$ may be bonded to each other to form a benzene ring; and $R_4$ and $R_5$, $R_5$, and $R_6$, $R_6$ and $R_7$, or $R_4$ and $R_8$ may be bonded to each other to form a ring.

7. The direct positive color photographic material as in claim 1, wherein the compound of the formula (II) is a compound represented by the general formula (IV):

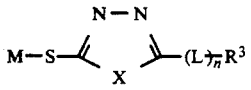

(IV)

wherein

M, $R^3$, L and n have the same meaning as in formula (II); and

X represents an oxygen atom, a sulfur atom or a selenium atom.

8. The direct positive color photographic material as in claim 1, wherein the compound of the formula (II) is a compound represented by the general formula (V):

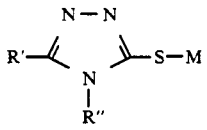

(V)

wherein

R′ represents a hydrogen atom, a halogen atom, a nitro group, a mercapto group, an unsubstituted amino group, or a substituted or unsubstituted alkyl, alkenyl, aralkyl or aryl group, or $-(L)_n-R^3$;

R″ represents a hydrogen atom, an unsubstituted amino group, or $-(L)_n-R^3$;

when R′ and R′ are both $-(L)_n-R^3$, they may the same or different, provided that at least one of R′ and R″ must be $-(L)_n-R^3$; and M, $R^3$, L and n have the same meaning as in formula (II).

9. The direct positive color photographic material as in claim 1, wherein the compound of the formula (II) is a compound represented by the general formula (VI):

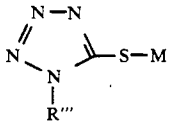

(VI)

wherein

R‴represents $-(L)_n-R^3$; and

M, $R^3$, L and n have the same meaning as in formula (II).

10. The direct positive color photographic material as in claim 1, wherein the compound of the general formula (II) is a compound represented by general formula (VII):

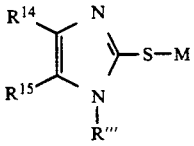

(VII)

wherein $R^{14}$ and $R^{15}$ each represents a hydrogen atom, a halogen atom, a substituted or unsubstituted amino group, a nitro group, or a substituted or unsubstituted alkyl, alkenyl, aralkyl or aryl group, or M, L, $R_3$ and n have the same meanings as in general formula (II) and R‴ represents $-(L)_n-R^3$.

11. The direct positive color photographic material as in claim 1, which contains a nucleating agent of the general formula (N-I) or (N-II):

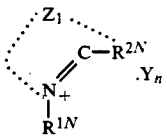

(N-I)

where $Z_1$ represents a non-metallic atomic group necessary for forming a 5-membered or 6-membered hetero ring, which may be substituted;

$R^{1N}$ represents an aliphatic group, which may be substituted;

$R^{2N}$ represents a hydrogen atom, an aliphatic group or an aromatic group, which may be substituted, and $R^{2N}$ may be bonded to the hetero ring completed by $Z_1$ to from a ring;

provided that at least one of $R^{1N}$, $R^{2N}$ and $Z_1$ contains an alkynyl group, an acyl group, a hydrazine group or a hydrazone group, or $R^{1N}$ and $R^{2N}$ together form a 6-membered ring to form a dihydropyridinium skeleton;

Y represents a pair ion for charge balance of the formula; and n represents 0 or 1:

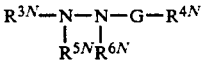

(N-II)

$R^{3N}$ represents an aliphatic group, an aromatic group or a heterocyclic group, which may be substituted;

$R^{4N}$ represents a hydrogen atom, an alkyl group, an aralkyl group, an aryl group, an alkoxy group, an aryloxy group or an amino group, which may be substituted;

G represents a carbonyl group, a sulfonyl group, a sulfoxy group, a phosphoryl group or an aminomethylene group, which may be substituted;

both $R^{5N}$ and $R^{6N}$ are hydrogen atoms, or one is a hydrogen atom and the other is an alkylsulfonyl group, an arylsulfonyl group or an acyl group, which may be substituted;

provided that G, $R^{4N}$ and $R^{6N}$ may form a hydrazone structure with the hydrazine nitrogen in the formula.

12. The direct positive color photographic material as in claim 1, wherein the amount of the magenta-coloring coupler represented by formula (M-II) is from $1\times10^{-3}$ to $1\times10^{-1}$ mol per mol of silver and the amount of the yellow-coloring coupler is from $1\times10^{-5}$ to $1\times10^{-2}$ mol per $m^2$ of the material.

13. A method of forming a direct positive image, wherein the direct positive color photographic material is as set forth in claim 1, wherein the method comprises the step of image-wise exposing the photographic material and the subsequent steps of light-fogging or chemical-fogging the previously non-fogged internal latent image silver halide emulsion and developing the photographic material with a surface developer.

14. The method of forming a direct positive image as in claim 13, comprising developing an image wise exposed direct positive color photographic material as set forth in claim 1 with a surface developer containing, as developing agent, a compound of the general formula (A):

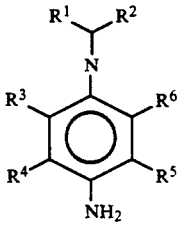

(A)

wherein $R^1$ and $R^2$ each represents a hydrogen atom or a substituted alkyl group $R^3$, $R^4$, $R^5$ and $R^6$ each represents a hydrogen atom, a halogen atom, a hydroxyl group, an amino group, an alkoxy group, an acylamino group, a sulfonamido group, an alkoxycarbonylamino group, a carbamoylamino group or an alkyl group, which may be substituted;

$R^1$ and $R^2$ may together form a hetero ring;

$R^3$ and $R^6$ may together form a condensed ring;

provided that when $R^1$ and $R^2$ are alkyl groups, they do not have a sulfonamido group as a substituent.

* * * * *